US009997028B2

(12) United States Patent
Kim et al.

(10) Patent No.: US 9,997,028 B2
(45) Date of Patent: Jun. 12, 2018

(54) FINANCIAL DEVICE

(71) Applicant: LG CNS CO., LTD., Seoul (KR)

(72) Inventors: Hak Kyum Kim, Seoul (KR); Seung Gill Baek, Seoul (KR)

(73) Assignee: LG CNS CO., LTD., Seoul (KR)

( * ) Notice: Subject to any disclaimer, the term of this patent is extended or adjusted under 35 U.S.C. 154(b) by 0 days. days.

(21) Appl. No.: 15/139,439

(22) Filed: Apr. 27, 2016

(65) Prior Publication Data

US 2016/0314662 A1 Oct. 27, 2016

(30) Foreign Application Priority Data

Apr. 27, 2015 (KR) ..... 10-2015-0058811

(51) Int. Cl.
*G07F 19/00* (2006.01)
*G07D 11/00* (2006.01)

(52) U.S. Cl.
CPC ..... *G07F 19/205* (2013.01); *G07D 11/0003* (2013.01); *G07D 11/0063* (2013.01); *G07D 11/0081* (2013.01)

(58) Field of Classification Search
USPC ..... 235/379
See application file for complete search history.

(56) References Cited

U.S. PATENT DOCUMENTS 6,435,329 B1 * 8/2002 Amari ..... G07D 11/0039 194/206
7,255,215 B2 * 8/2007 Iannello ..... G07F 7/04 194/206

(Continued)

FOREIGN PATENT DOCUMENTS

EP 2444943 A1 4/2012
JP H09208134 A 8/1997

(Continued)

OTHER PUBLICATIONS

Office Action dated Jul. 13, 2016 in Korean Application No. 1020150058811.

(Continued)

*Primary Examiner* — Michael G Lee
*Assistant Examiner* — David Tardif
(74) *Attorney, Agent, or Firm* — Saliwanchik, Lloyd & Eisenschenk

(57) ABSTRACT

The financial device comprises a medium depositing and withdrawing module, a discrimination module for discriminating the medium, a first transfer module for guiding the medium of the medium depositing and withdrawing module to the discrimination module, a temporary staking module in which a medium to be withdrawn is temporarily stacked, a first connection module transferring a medium between the discrimination module and the temporary staking module, a medium storage unit for storing a medium to be deposited or to be withdrawn, a second connection module for guiding a medium passing through the first connection module to the medium storage unit, a first frame in which the second connection module is installed, and a second frame in which the first connection module and the discrimination module are installed, and rotatably connected to the first frame. When rotating the second frame with respect to the first frame, the second connection module is exposed.

20 Claims, 12 Drawing Sheets

(56) References Cited

U.S. PATENT DOCUMENTS

| | | | | |
|---|---|---|---|---|
| 7,891,551 | B2 | 2/2011 | Cha et al. | |
| 9,474,394 | B2 * | 10/2016 | Komatsu | G07D 11/0018 |
| 2011/0198192 | A1 * | 8/2011 | Togiya | B65H 5/062 194/206 |

FOREIGN PATENT DOCUMENTS

| | | | |
|---|---|---|---|
| KR | 1020070119342 | A | 12/2007 |
| KR | 20120097457 | A | 9/2012 |
| KR | 20140122352 | A | 10/2014 |

OTHER PUBLICATIONS

European Search Report dated Sep. 29, 2016 in European Application No. 16167023.7.

* cited by examiner

FINANCIAL DEVICE

CROSS-REFERENCE TO RELATED APPLICATIONS

This application claims priority under 35 U.S.C. § 119 to Korean Patent Application No. 10-2015-0058811, filed Apr. 27, 2015, which is hereby incorporated by reference in its entirety.

BACKGROUND

Generally, financial devices are devices that process a financial transaction that is desired by a customer. The financial devices may deposit/withdraw a medium or automatically transfer a medium.

The financial devices may comprise a medium depositing and withdrawing module for depositing and withdrawing a medium, a medium recognition module for recognizing a medium, a temporary staking module for temporarily staking a medium, and a medium storage module for storing a medium. Each of these modules may be connected one another by a transfer path.

Further, when it is needed to release a medium jam on the transfer path or maintain the transfer path, the transfer path needs to be opened.

A bill receiving/dispensing machine is disclosed in a prior document of Korean Patent Laid-Open No. 2002-0052949.

The bill receiving/dispensing machine comprises an upper unit having a receiving/dispensing gate, a bill determining portion and a temporary storage, and a lower unit having a bill storage. The upper unit moves in the horizontal direction using a slide rail equipment.

For example, when it is needed to maintain a transfer path disposed under the lower unit, the entire lower unit should be withdrawn from a device frame and then a module disposed above the transfer path should be separated. As to the prior document, accordingly, there is a problem that a lot of maintenance space is needed. In case that a sufficient space for the maintenance is not secured, there is a problem of uneasy maintenance.

Further, in case of maintaining a lower transfer path in the lower unit, since an operator should access to the transfer path disposed under the lower unit in the state that he or she is located under the lower unit, unless separating the modules disposed above the transfer path, there is a problem that the works of the operator are not easy.

BRIEF SUMMARY

Embodiments provide a financial device, capable of providing a reduced space for maintenance and thereby providing a convenient maintenance.

In one embodiment, a financial device comprises A financial device comprises a medium depositing and withdrawing module having a medium storing space for storing a medium; a discrimination module for discriminating the medium; a first transfer module for guiding the medium of the medium depositing and withdrawing module to the discrimination module; a temporary staking module in which a medium to be withdrawn, which passes through the discrimination module, is temporarily stacked; a first connection module transferring a medium between the discrimination module and the temporary staking module; a medium storage unit for storing a medium to be deposited and a medium to be withdrawn; a second connection module for guiding a medium passing through the first connection module to the medium storage unit; a first frame in which the second connection module is installed; and a second frame in which the first connection module and the discrimination module are installed, and which is connected rotatably to the first frame, wherein when rotating the second frame with respect to the first frame, the second connection module is exposed.

In another embodiment, a financial device comprises a medium depositing and withdrawing module having a medium storing space for storing a medium; a discrimination module for discriminating the medium; a first transfer module for guiding the medium of the medium depositing and withdrawing module to the discrimination module; a temporary staking module in which a medium to be withdrawn, which passes through the discrimination module, is temporarily stacked; a first connection module transferring a medium between the discrimination module and the temporary staking module; a medium storage unit for storing a medium to be deposited and a medium to be withdrawn; and a second connection module for guiding a medium passing through the first connection module to the medium storage unit, wherein when the medium depositing and withdrawing module, the discrimination module, the first transfer module, the temporary staking module and the first connection module are rotated with respect to the second connection module in a first direction in the state of defining a path thereof, the second connection module is exposed.

DETAILED DESCRIPTION

Figure 1:
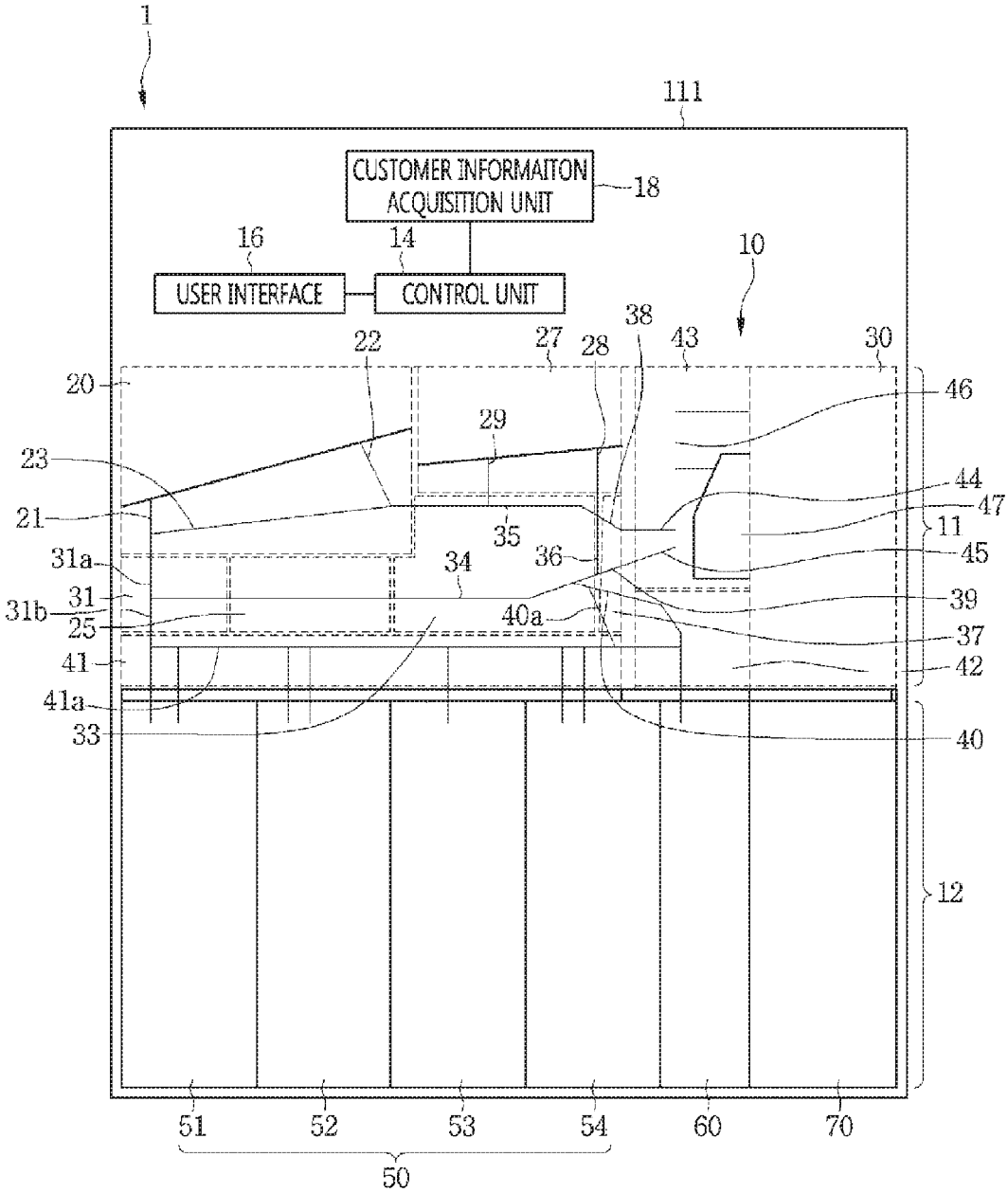
FIG. 1 is a schematic view of a financial device according to an embodiment.

Hereinafter, exemplary embodiments of the present disclosure will be described with reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

Also, in the description of embodiments, terms such as first, second, A, B, (a), (b) or the like may be used herein when describing components of the present disclosure. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

A financial device according to embodiments is a device that performs financial business, such as medium processing including processing such as deposit processing, giro receipt, or gift certificate exchange and/or processing such as withdrawal processing, giro dispensing, or gift certificate dispensing by receiving various media such as, e.g., paper money, bills, giros, coins, gift certificates, etc. For example, the financial device may comprise an automatic teller machine (ATM) such as a cash dispenser (CD) or a cash recycling device. However, the financial device is not limited to the above-described examples. For example, the financial device may be a device for automatically performing the financial business such as a financial information system (FIS).

Hereinafter, assuming that the financial device is an ATM, an embodiment will be described. However, this assumption is merely for convenience of description, and the present disclosure is not limited to the ATM.

According to the present invention, a financial device may be transformed into various configurations. Also, in order to use the financial device having the various configurations, the financial device may comprise a common module that is commonly provided in configurations.

In this specification, the financial device may vary in configuration according to the number of modules or an arrangement of the modules and a size or use of the financial device depending on the arrangement of the modules.

The module described in this specification may be a component for performing at least one independent function and capable of being coupled to another module. Also, the module may be manufactured such that a plurality of detailed modules may be coupled to each other.

The common modules as described above may have the same configuration and arrangement, regardless of the configuration of the financial device.

FIG. 1 is a schematic view of a financial device according to an embodiment.

FIG. 1 illustrates a state in which the financial device is used in a first configuration.

Referring to FIG. 1, a financial device 1 according to an embodiment may comprise a medium processing apparatus 10 for processing a medium.

The financial device 1 may comprise a housing 111 for protecting the medium processing apparatus 10, regardless of a configuration thereof. The housing 111 may vary in size and configuration according to its purpose of use, module constituents, functions of the financial device 1, etc.

A door (not shown) openable to access the medium processing apparatus 10 may be connected to the housing 111. While the door may be generally disposed at a rear side of the financial device and opened by a teller or worker, it may be disposed at a front side of the financial device.

The financial device 1 may further comprise a customer information acquisition unit 18 for acquiring information of a customer.

The customer information acquisition unit 18 may comprise a bankbook processing module through which a bankbook is insertable and withdrawable for recognizing the bankbook, and/or a card processing module through which a card is insertable and withdrawable and for recognizing the card. Alternatively, the customer information acquisition unit 18 may comprise a near field communication module.

The current embodiment is not limited to a kind of customer information acquisition unit 18. For example, the customer information acquisition unit 18 may acquire information recorded in an RFID tag or USB or may acquire customer's information by using bio-information such as customer's fingerprint.

The financial device 1 may further comprise a user interface 16 which displays a menu and information for depositing or withdrawing a medium or for inputting or selecting a command or information for depositing or withdrawing the medium.

The financial device 1 may further comprise a control unit 14, such as a microprocessor or electronic control circuitry, for controlling the medium processing apparatus 10 and the user interface 16. Here, the control unit 14 may comprise a medium processing apparatus control part for controlling the medium processing apparatus 10 and a financial device control part for controlling the financial device 1.

The medium processing apparatus 10 may comprise an upper unit 11 and a lower unit 12. The upper unit 11 may be separably connected to the lower unit 12 or movably connected to the lower unit 12. Alternatively, the upper unit 11 and the lower unit 12 may not be connected to each other, but maintained in contact with each other.

The medium processing apparatus 10 may comprise a medium depositing and withdrawing module 20 for depositing and withdrawing a medium.

The medium depositing and withdrawing module 20 may have a medium storing space that is accessible by a customer. The medium storing space may be opened or closed by a covering member (not shown) such as a shutter and/or cover. In some cases, the medium storing space may be maintained in an opened state. The medium storing space may be partitioned into a plurality of storing spaces by a partition member.

The medium depositing and withdrawing module 20 may serve as a common entrance part through which various kinds of media such as bills and/or checks are capable of depositing or withdrawing. The media may be accepted into the medium depositing and withdrawing module 20 in a bundle. Alternatively, the media may be withdrawn into the medium depositing and withdrawing module 20 in a bundle. Here, the bills and checks may be deposited and withdrawn together in the medium depositing and withdrawing module 20 in a bundle.

Alternatively, within the medium depositing and withdrawing module 20, a depositing space into which the medium is accepted and a withdrawing space from which the medium is withdrawn are divided by the partition member. Alternatively, the medium depositing and withdrawing module 20 may comprise a medium depositing module and a medium withdrawing module which are independent from each other.

The medium depositing and withdrawing module 20 may have a first path 21 through which the medium in the medium storing space is transferred and a second path 22 through which a medium to be stored into the medium storing space is transferred.

The medium depositing and withdrawing module 20 may further have a third path 23 that is distinguished from the first path 21 and the second path 22.

In this specification, formation of a path for a specific module may comprise formation of a path for the specific module alone as well as formation of a path of the specific module together with another module.

Further, in the case of forming a path for the specific module along, a path formation unit of the specific module may also form a path. A plurality of path formation units for the specific module may also have a path.

Further, the term "a path is opened" means a direct opening of the path by movement of a specific module or means a state that it becomes possible to access to a portion of the path from the outside.

The term "a path becomes in a state to be opened" means a state that, in case that the path is defined by a plurality of path formation units, it is possible to make a movement (including a rotation) of at least one of the plurality of path formation units, thereby opening the path.

The medium processing apparatus 10 may further comprise a discrimination module 25. The discrimination module 25 may identify a kind, thickness, and sum of medium during a deposit transaction process and a withdrawal transaction process of the medium or determine an abnormal medium or a forged medium.

The medium processing apparatus 10 may further comprise a first transfer module 31 for transferring media stored in the medium depositing and withdrawing module 20 to the discrimination module 25.

The first transfer module 31 may receive a medium in the first path 21 of the medium depositing and withdrawing module 20 to transfer the received medium to the discrimination module 25. The first transfer module 31 may comprise a main path 31*a*. The main path 31*a* may connect the medium depositing and withdrawing module 20 to the discrimination module 25. The first transfer module 31 may further comprise a branch path 31*b* connected to the main path 31*a*. The branch path 31*b* may be connected to a fourth transfer module 41.

The first transfer module 31 and the discrimination module 25 may be disposed under the medium depositing and withdrawing module 20.

At least a portion of the first transfer module 31 may be disposed to vertically overlap with the medium depositing and withdrawing module 20. Also, at least a portion of the discrimination module 25 may be disposed to vertically overlap with the medium depositing and withdrawing module 20.

The medium processing apparatus 10 may further comprise a second transfer module 33 for transferring the medium passing through the discrimination module 25. The second transfer module 33 may be disposed at a side opposite to the first transfer module 31 with respect to the discrimination module 25.

The second transfer module 33 may define a fourth path 34 and a fifth path 35 which are separate paths. The medium passing through the discrimination module 25 may be transferred along the fourth path 34.

The medium to be transferred into the medium depositing and withdrawing module 20 may be transferred along the fifth path 35. The medium transferred along the fifth path 35 may be transferred into the second path 22 or the third path 23.

Although not limited thereto, the fourth path 34 and the fifth path 35 may be vertically arranged with each other.

The medium processing apparatus 10 may further comprise a temporary staking module 27 for temporarily stacking media.

The temporary staking module 27 may temporarily stack media received through the medium depositing and withdrawing module 20 while the deposit transaction process.

The media stacked in the temporary staking module 27 may be transferred to a medium storage unit 50 that will be described below or return to the medium depositing and withdrawing module 20 while the deposit transaction process.

The temporary staking module 27 may be disposed at a rear side of the medium depositing and withdrawing module 20. At least a portion of the temporary staking module 27 may be disposed to horizontally overlap with the medium depositing and withdrawing module 20. To realize compactness of the financial device 1 and simplification of the path, the whole of the temporary staking module 27 may be disposed to horizontally overlap with the medium depositing and withdrawing module 20. In this specification, the "front direction" may be a direction that is directed to a front surface of the financial device, and the "rear direction" may be a direction that is directed to a rear surface of the financial device. In this specification, the front surface of the financial device may be a left surface in FIG. 1.

Also, in a state where other modules or paths are not disposed between the medium depositing and withdrawing module 20 and the temporary staking module 27, the temporary staking module 27 may be disposed at a rear side of the medium depositing and withdrawing module 20. Thus, the medium in the medium depositing and withdrawing module 20 may be transferred to the temporary staking module 27 in which the medium does not pass between the temporary staking module 27 and the medium depositing and withdrawing module 20. Also, the medium withdrawn from the temporary staking module 27 may be transferred to the second path 22 or the third path 23 in which the medium does not pass between the temporary staking module 27 and the medium depositing and withdrawing module 20.

At least a portion of the temporary staking module 27 may be disposed to vertically overlap with the second transfer module 33.

The temporary staking module 27 may define an introduction path 28 and a withdrawal path 29. The withdrawal path 29 may be connected to the fifth path of the second transfer module 33.

In the temporary staking module 27, the medium may be stacked to stand up so that a long side having a relatively long length of the medium is supported by a stacking surface. Also, the medium may be transferred upward along the introduction path 28 and be transferred downward along the withdrawal path 29.

The second transfer module 33 may further define a portion or the whole of a guide path 36 for guiding the medium in the fourth path 34 to the fifth path 35.

The guide path 36 may be connected to the introduction path 28 of the temporary staking module 27. In another example, the introduction path 28 may be connected to the fifth path 35.

The medium processing apparatus 10 may further comprise a third transfer module 37 connected to the second transfer module 33 on the path.

The third transfer module 37 may define the guide path 36 together with a portion or the whole of the second transfer module 33.

In another example, the third transfer module 37 may solely define the guide path 36. Alternatively, the second transfer module 33 may solely define the guide path 36.

The third transfer module 37 may be disposed at a rear side of the second transfer module 33. Also, at least a portion of the third transfer module 37 may be disposed to vertically overlap with the temporary staking module 27.

The third transfer module 37 may define a plurality of connection paths 38 to 40 which are vertically arranged.

Although not limited thereto, the plurality of connection paths 38 to 40 may comprise a first connection path 38, a second connection path 39 disposed under the first connection path 38, a third connection path 40 disposed under the second connection path 39, and a fourth connection path 40*a* disposed under the third connection path 40.

The medium processing apparatus 10 may further comprise a medium storage unit 50 for storing a medium. The medium storage unit 50 may comprise a plurality of medium storage modules 51 to 54.

The plurality of medium storage modules 51 to 54 may comprise at least one bill storage module and at least one check storage module. This specification is not limited to the number of bill storage modules and the number of check storage modules. As another example, the medium storage unit 50 may comprise only the bill storage module for storing bills or only the check storage module for storing checks. Alternatively, the plurality of medium storage modules 51 to 54 may comprise storage modules for storing gift certificates, securities, tickets, and the like. Alternatively, the check storage module may be replaced with a storage module for storing gift certificates, securities, tickets, and the like. Here, the medium storage module may be embodied in a cassette, a box, a bin, and the like.

In this specification, a process in which the media accepted into the medium depositing and withdrawing module 20 are transferred and stacked in the temporary staking module 27 may be called a first deposit process, and a process in which the media temporarily stacked in the temporary staking module 27 are transferred to and stored in the medium storage unit 50 may be called a second deposit process.

The medium processing apparatus 10 may further comprise a fourth transfer module 41 for transferring a medium transferred from the third transfer module 37 to the medium storage unit 50.

The fourth transfer module 41 may further comprise a sixth path 41*a*. The fourth transfer module 41 may be disposed under the first transfer module 31, the discrimination module 25, the second transfer module 33, and the third transfer module 37.

Each of the first transfer module 31, the discrimination module 25, the second transfer module 33, and the third transfer module 37 may be disposed to vertically overlap with at least a portion of the fourth transfer module 41.

Also, the temporary staking module 27, the second transfer module 33, the fourth transfer module 41, and the medium storage unit 50 may be disposed to vertically overlap with each other.

Also, the medium depositing and withdrawing module 20, the discrimination module 25, the fourth transfer module 41, and the medium storage unit 50 may be disposed to vertically overlap with each other.

The branch path 31*b* of the first transfer module 31 may be connected to the sixth path 41*a* of the fourth transfer module 41.

The medium processing apparatus 10 may further comprise a fifth transfer module 42. The fifth transfer module 42 may connect the third transfer module 37 to the fourth transfer module 41. That is, the fifth transfer module 42 may transfer a medium transferred from one module of the third and fourth transfer modules 37 and 41 to the other module.

The medium processing apparatus 10 may further comprise a sixth transfer module 43. The sixth transfer module 43 may transfer a medium to the third transfer module 37 or receive a medium from the third transfer module 37. Although not limited thereto, the sixth transfer module 43 may transfer a medium in two directions.

The sixth transfer module 43 may comprise a first branch path 44 connected to a first connection path 38 of the third transfer module 37, a second branch path 45 connected to a second connection path 39 of the third transfer module 37, and a common path 46 connected to a first branch path 44 and a second branch path 45.

The sixth transfer module 43 may further comprise a collection part 47 for collecting a medium. Although not limited thereto, the collection part 47 may receive at least one of a medium that is not yet received by the customer even though the medium is withdrawn to the customer through the medium depositing and withdrawing module 20, and/or a medium that is determined as an abnormal medium in the discrimination module 25, and a medium that is not recognized in the discrimination module 25. Alternatively, the collection part 47 may be separably provided with respect to the sixth transfer module 43 and connected to the sixth transfer module 43.

The fifth transfer module 42 may be disposed at a rear side of the fourth transfer module 41, and the sixth transfer module 43 may be disposed at rear sides of the third transfer module 41 and the temporary staking module 27.

The sixth transfer module 43 may be disposed above the fifth transfer module 42. At least a portion of the sixth transfer module 43 may be disposed to vertically overlap with the fifth transfer module 42.

The medium processing apparatus 10 may further comprise an additional function module 30 for performing an additional function including replenishment or collection function for replenishing or collecting a medium or an audit function for precisely checking the number of media stored in the medium storage unit 50. For example, the additional function module 30 may store at least one of a medium to be replenished in the medium storage unit 50 and a medium collected from the medium storage unit 50.

The additional function module 30 may be disposed at rear sides of the fifth and sixth transfer modules 42 and 43. The additional function module 30 may receive a medium from the fifth transfer module 42 or transfer a medium to the fifth transfer module 42.

The medium processing apparatus 10 may further comprise a seventh transfer module 60. The seventh transfer module 60 may be one component of the lower unit 12 and be separably coupled to a lower frame. In detail, the seventh transfer module 60 may be realized in the form of the cassette that is not fixed to the lower unit 12 through a coupling unit, but is detachably coupled to the lower unit 12.

The seventh transfer module 60 may receive a medium from the fifth transfer module 42 or transfer a medium to the fifth transfer module 42.

The seventh transfer module 60 may be horizontally disposed with respect to the plurality of medium storage modules 51 to 54 (disposed in a row with the plurality of medium storage modules 51 to 54).

The medium processing apparatus 10 may further comprise a collection module 70. The collection module 70 may store an abnormal medium occurring in at least one process of a medium deposit transaction process, a medium withdrawal transaction process, a medium replenishment process, and a medium collection process and a medium that is determined as a medium, which is unsuitable to be stored in the medium storage module 50.

Also, the medium processing apparatus 10 may further comprise a deposited check storing space into which the deposited check is stored when the financial device 1 has a check deposit/withdrawal function. Here, the deposited checks may be divided into checks issued by own bank and checks issued by another bank and then stored. The deposited check storing space may be provided as a module separated from the collection module 70. Also, the deposited check storing space may be separated from the spaces partitioned within the collection module 70 and then stored. The collection module 70 and/or the deposited check storing space may be disposed at the most rear side of the financial device so that the teller or manager opens a door to easily access to the collection module 70 and/or the check storing space.

The collection module 70 may constitute the lower unit and horizontally arranged with respect to the plurality of medium storage modules 51 to 54 and the seventh transfer module 60.

Also, the collection module 70 may be disposed under the additional function module 30 to vertically overlap with at least a portion of the additional function module 30.

Thus, according to the current embodiment, the upper unit 11 may comprise the medium depositing and withdrawing module 20, the first transfer module 31, the discrimination module 25, the second transfer module 33, the temporary staking module 27, the third transfer module 37, the fourth transfer module 41, the fifth transfer module 42, the sixth transfer module 43, and the additional function module 30.

The lower unit 12 may comprise the medium storage unit 50, the seventh transfer module 60, and the collection module 70. However, the fourth transfer module 41 may not be provided in the upper unit 11, but provided in the lower unit 12.

Hereinafter, a transfer of medium will be described in a financial transaction process.

<Deposit Transaction Process>

In order to process the deposit transaction, the medium may be accepted into the medium storing space of the medium depositing and withdrawing module 20. The media accepted into the medium storing space may be separated by a sheet of media by a medium separation device. The media separated by the sheet of media may be transferred to the first transfer module 31 via the first path 21. The first transfer module 31 may transfer the medium to the discrimination module 25.

The discrimination module 25 may determine a kind of medium, whether the medium is a normal medium, and the like.

The medium that is determined as the normal medium by the discrimination module 25 may be transfer to the temporary staking module 27 by the second transfer module 33 and the third transfer module 37. For example, the medium that is determined as the normal medium by the discrimination module 25 may be stacked in the temporary staking module 27 via the fourth path 34, the connection path 36, and the introduction path 28.

On the other hand, the medium that is determined as the abnormal medium by the discrimination module 25 or the medium that is not recognized by the discrimination module 25 (hereinafter, referred as "medium determined as a medium that is unsuitable to be stored in the medium storage module") may be transferred to the medium depositing and withdrawing module 20 by the second transfer module 33 and the third transfer module 37. For example, the medium that is unsuitable to be stored in the medium storage module may be transferred to the medium depositing and withdrawing module 20 via the fourth path, the connection path 36, the fifth path 35, and the second path 22.

When the first deposit process is completed, information (for example, at least one of the denomination, kind, and number of media) of the medium that is completely discriminated and stacked in the temporary staking module 27 may be displayed on the user interface 16. Also, a deposit confirmation command or deposit cancel command with respect to the medium stacked in the temporary staking module 27 may be received through the user interface 16.

If the deposit confirmation command is received through the user interface 16, the medium stacked in the temporary staking module 27 may be separated by the medium separation device (not shown). The medium separated by the medium separation device is transferred to the fifth path 35 via the withdrawal path 29. The medium transferred to the fifth path 35 is transferred to the third path 23 defined by the medium depositing and withdrawing module 20. The medium transferred to the third path 23 may pass again through the discrimination module 25 via the first transfer module 31.

The medium passing again through the discrimination module 25 may be transferred to the fifth transfer module 42 via the second transfer module 33 and the third transfer module 37. The medium that is determined as the normal medium among the media passing again through the discrimination module 25 may be transferred to the fourth transfer module 41 by the fifth transfer module 42. Also, the medium transferred to the fourth transfer module 41 may be finally accepted into the medium storage unit 50.

On the other hand, the medium that is determined as the medium, which is unsuitable to be stored in the medium storage module 50, of the media passing again through the discrimination module 25 may be transferred to the seventh transfer module 60 by the fifth transfer module 42. The medium transferred to the seventh transfer module 60 may be finally stored in the collection module 70.

When the deposit cancel command is received through the user interface 16, the media stored in the temporary staking module 27 may be separated with one another by the medium separation device (not shown). The medium separated by the medium separation device may be transferred to the fifth path 35 via the withdrawal path 29. The medium transferred to the fifth path 35 may be transferred to the medium depositing and withdrawing module 20 via the second path 22 defined by the medium depositing and withdrawing module 20.

<Withdrawal Transaction Process>

When a medium withdrawal command is received through the user interface 16, a kind and the number of medium corresponding to the received sum of the medium to be withdrawn may be discharged from the medium storage unit 50. The medium discharged from the medium storage unit 50 may be transferred along the fourth transfer module 41 to pass through the discrimination module 25 via the first transfer module 31.

The medium determined as the normal medium among the media passing through the discrimination module 25 may be transferred to the medium depositing and withdrawing module 20 by the second and third transfer modules 33 and 37.

On the other hand, the medium that is determined as a medium, which is unsuitable to be stored in the medium storage unit, of the media which pass through the discrimination module 25 may be transferred to the collection module 70 via the second, third, fourth and seventh transfer modules 33, 37, 42 and 60.

<Replenishment Process>

When a medium replenishment command is received through a teller interface (not shown) or a user interface 16, the medium stored in the additional function module 30 is discharged from the additional function module 30.

The medium discharged from the additional function module 30 is transferred to the second transfer module 33 via the sixth transfer module 43 and the third transfer module 37. The medium to be replenished, which is transferred to the second transfer module 33 may pass through the third path 33 defined by the medium depositing and withdrawing module 20. The medium to be replenished, which passes through the third path may pass through the discrimination module 25 by the first transfer module 31.

The medium to be replenished, which passes through the discrimination module 25 is transferred to the fifth transfer module 42 via the second and third transfer modules 33 and 37.

The medium that is determined as the normal medium among the media to be replenished, which passes through the discrimination module 25 may be transferred to the fourth transfer module 41 by the fifth transfer module 42. Also, the medium transferred to the fourth transfer module 41 may be finally replenished to the medium storage unit 50. On the other hand, the medium that is determined as a medium, which is unsuitable to be stored in the medium storage unit, of the media to be replenished, which pass again through the discrimination module 25 may be transferred to the seventh transfer module 60 by the fifth transfer module 42. The medium transferred to the seventh transfer module 60 may be finally stored in the collection module 70.

<Collection Process>

If a medium collection command is received through a teller interface (not shown) or the user interface 16, the media stored in at least one medium storage module of the plurality of medium storage modules 51 to 54 are discharged and then transferred to the fourth transfer module 41. The medium to be collected, which is transferred to the fourth transfer module 41 may pass through the discrimination module 25 via the first transfer module 31.

The medium that is determined as the normal medium among the media to be collected, which pass through the discrimination module 25 may be transferred to the sixth transfer module 43 by the second and third transfer modules 33 and 37, and then finally stored in the additional function module 30.

On the other hand, the medium that is determined as a medium, which is unsuitable to be stored in the additional function module 30, of the media to be collected, which pass again through the discrimination module 25 may be transferred to the seventh transfer module 60 by the second, third and fifth transfer modules 33, 37 and 42. The medium transferred to the seventh transfer module 60 may be finally stored in the collection module 70.

<Non-Receipt Medium Collection Process>

In the withdrawal transaction process, when the customer does not receive the medium withdrawn to the medium depositing and withdrawing module 20, the non-receipt medium may pass through the first path 21 and then be transferred to the discrimination module 25 by the first transfer module 31. The non-receipt medium that passes through the discrimination module 25 may be transferred to the sixth transfer module 43 by the second and third transfer modules 33 and 37 and then be finally transferred to the collection part 47 provided in the sixth transfer module 43.

Figure 2:
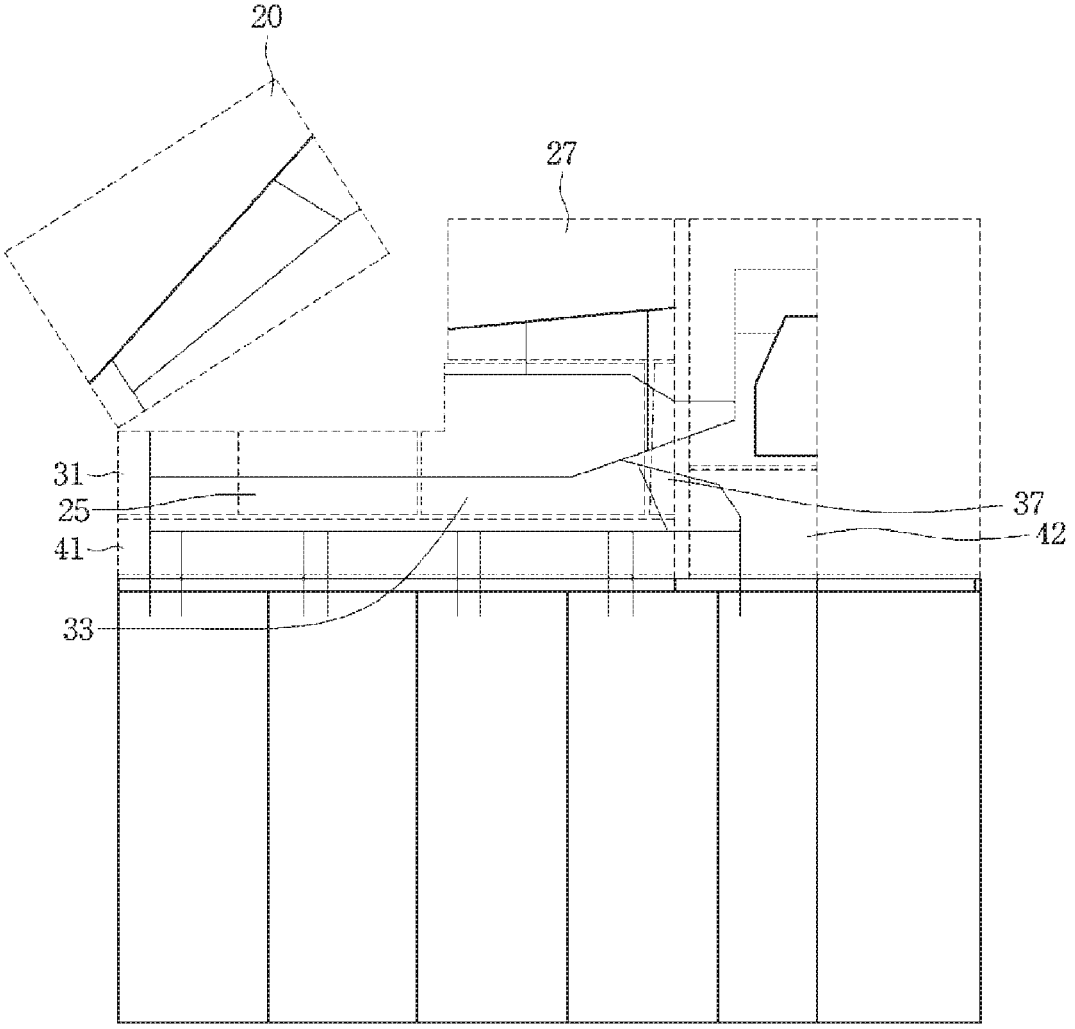
FIG. 2 is a view illustrating a state that a medium depositing and withdrawing module moves to open a path defined by the medium depositing and withdrawing module.

FIG. 2 is a view illustrating a state that a medium depositing and withdrawing module moves to open a path defined by the medium depositing and withdrawing module.

Referring to FIGS. 1 and 2, the medium depositing and withdrawing module 20 may be rotatably connected to the first transfer module 31. For example, the medium depositing and withdrawing module 20 may be rotatably connected to the first transfer module 31 by a bracket (not shown).

For another example, the medium depositing and withdrawing module 20 may be rotatably connected to a second frame (referring to 92 in FIG. 3) that supports the first transfer module 31. In any case, the medium depositing and withdrawing module 20 may be rotatable with respect to the first transfer module 31.

The medium depositing and withdrawing module 20 may define the first to third paths 21 to 23. Further, when rotating the medium depositing and withdrawing module 20 with respect to the first transfer module 31 in a first direction (in a counterclockwise direction in the drawing), the first to three paths 21 to 23 are opened or in a state to be opened. Here, the medium disposed in the path that is not opened may be removed by operating a transfer unit such as a belt or a roller in the path using a manually operating equipment such as a knob.

Also, when the medium depositing and withdrawing module 20 is rotated in the first direction, the first transfer module 31 is exposed to the outside so that the operator may easily access to the path defined by the first transfer module 31.

Figure 3:
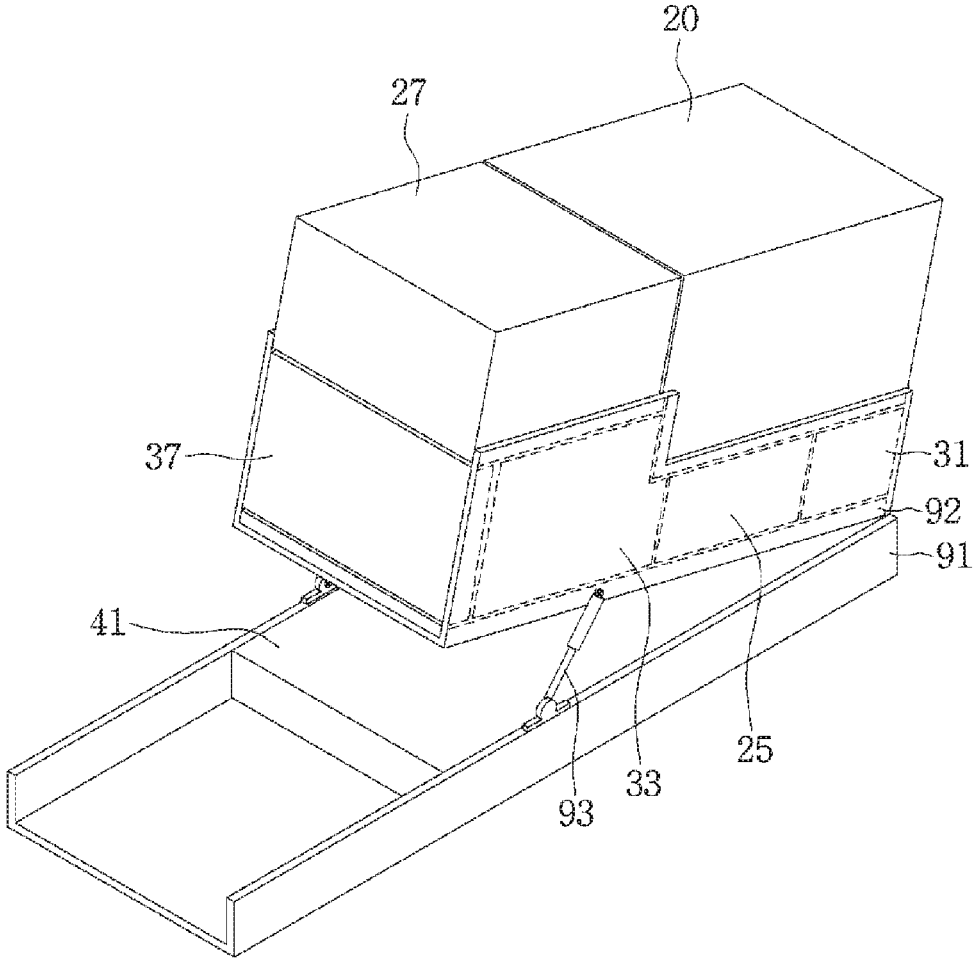
FIG. 3 is a view illustrating a configuration to open a fourth transfer module according to an embodiment.
Figure 4:
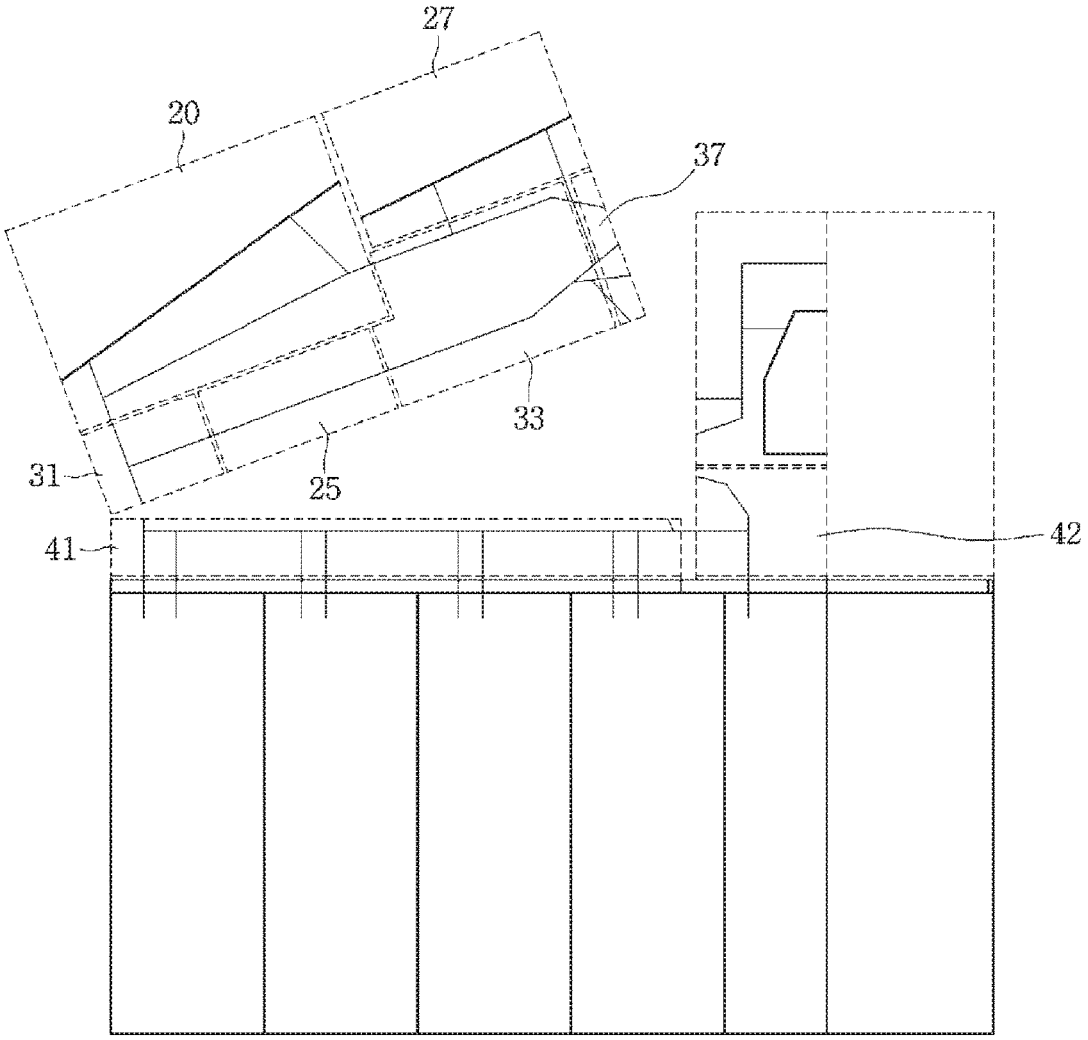
FIG. 4 is a view illustrating a state that the fourth transfer module is exposed according to an embodiment.
Figure 5:
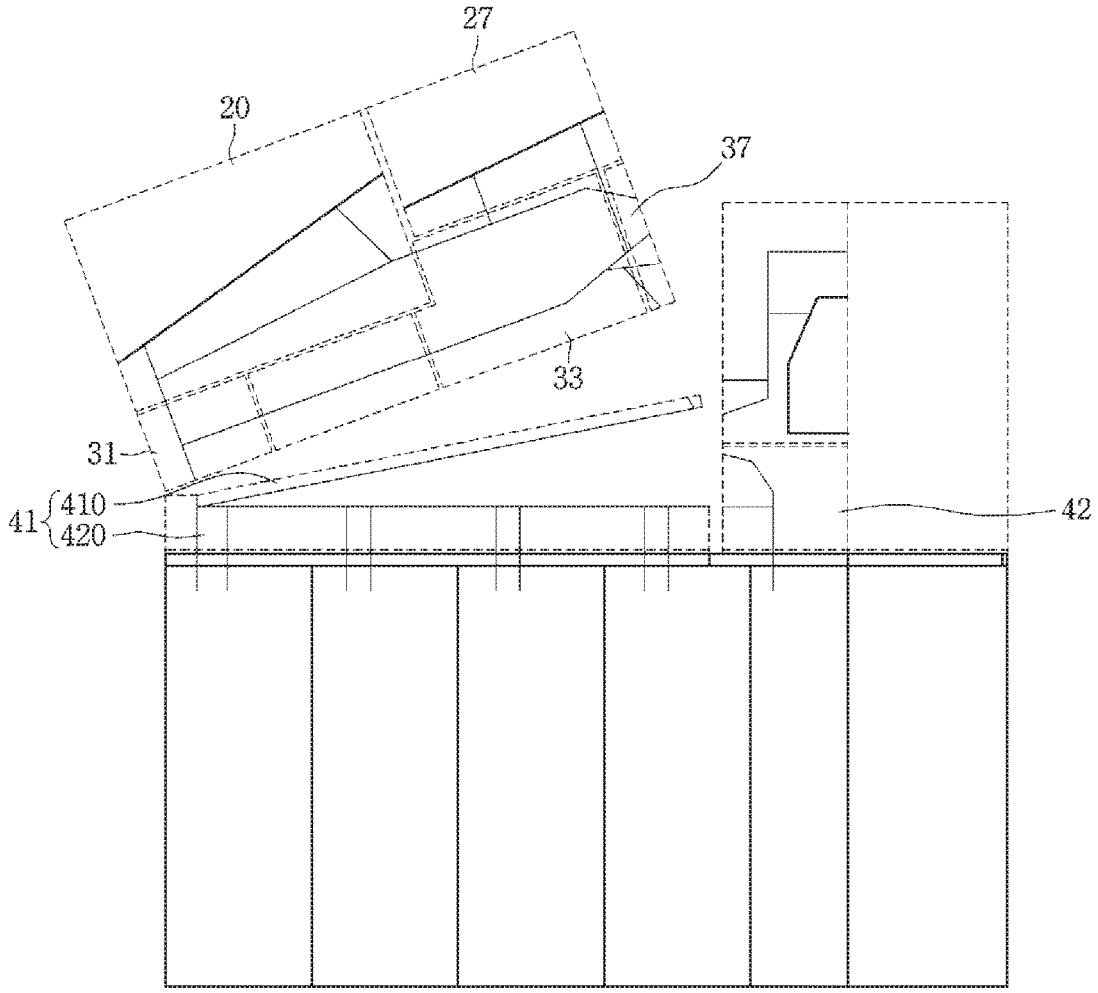
FIG. 5 is a view illustrating a state that a path defined by the fourth transfer module is opened according to an embodiment.

FIG. 3 is a view illustrating a configuration to open a fourth transfer module according to an embodiment, FIG. 4 is a view illustrating a state that the fourth transfer module is exposed according to an embodiment, and FIG. 5 is a view illustrating a state that a path defined by the fourth transfer module is opened according to an embodiment.

Referring to FIGS. 3 to 5, the fourth transfer module 41 may be installed in the first frame 91. The first frame 91 may be drawn to the outside of the housing 11 by a rail assembly which is not shown.

The first frame 91 may also be installed with the fifth transfer module 42 and the additional function module 30.

The first frame 91 may be ratatably connected to the second frame 92. At least a portion of the second frame 92 may cover the upper side of the fourth transfer module 41.

Accordingly, when the first frame 91 is drawn from the housing 11, the second frame 92 may also be drawn together.

The second frame 92 may be installed with the first transfer module 31, the discrimination module 22, the second transfer module 33 and the third transfer module 37.

A portion or the whole of the first transfer module 31 may be rotatably installed in the second frame 92. Alternatively, the first transfer module 31 may also be installed in the second frame 92 in the non-rotatable state.

A portion or the whole of the second transfer module 33 may be rotatably installed in the second frame 92.

A portion or the whole of the third transfer module 37 may be rotatably installed in the second frame 92.

At least a portion of each of the first transfer module 31, the discrimination module 25, the second transfer module 33 and the third transfer module 37 may cover the upper side of the fourth transfer module 41.

The second frame 92 may be rotatably installed with the temporary staking module 27. Alternatively, the temporary staking module 27 may also be rotatably connected to the second transfer module 33.

The first and second frames 91 and 92 may be connected each other by a damping device 93. The damping device 93 may keep the rotation state of the second frame 92 when the second frame 92 is rotated in one direction to expose the fourth transfer module 41. Further, the damping device may serve to reduce the rotation speed of the second frame 92 in the other direction opposite to the one direction of the second frame 92. The damping device 93 may comprise a gas spring, for example.

Accordingly, when rotating the second frame 92 in the first direction (in the counterclockwise direction in FIG. 4) with respect to the first frame 91, the fourth transfer module 41 may be exposed. Accordingly, the operator may access to the fourth transfer module 41 from the upper side of the fourth transfer module 41.

Also, the fourth transfer module 41 may be separated from the first frame 91 in the state that the second frame 92 exposes the fourth transfer module 41.

According to current embodiment, since it is possible to access to the fourth transfer module 41 that is disposed at the most lower side of the upper unit 11 by rotating the second frame 92, there is an advantage that the space to maintain the fourth transfer module 41 may be reduced.

Here, since it is possible to access to the fourth transfer module 41 by rotating the second frame 92 in the state that the first frame 91 to support the fourth transfer module 41 to the outside of the housing 111 is drawn not wholly but partially or the first frame 91 is fixed in the housing 111, a working space to maintain may be reduced.

Further, since the operator may access to the upper side of the fourth transfer module 41 in the state that the second frame 92 is rotated so that the fourth transfer module 41 is exposed, there is an advantage that operator's works become easy.

Further, since it is possible to access to the fourth transfer module 41 installed in the first frame 91 in the state that the second frame 92 is rotated, there is an advantage that it is possible to maintain or replace the fourth transfer module 41 without disassembling other modules.

That is, since the second frame 92 is connected to the medium depositing and withdrawing module 20, the discrimination module 25, the first transfer module 31, the second transfer module 33, the temporary staking module 27 and the third transfer module 37 directly or by a connection member, when the second frame 92 rotates with respect to the first frame 91, the component elements may rotate together with the second frame 92. Accordingly, since it is possible to access to the fourth transfer module 41 disposed at the most lower side by rotating the second frame 92 only, without accessing to or moving the other component elements, there is an advantage of an easy maintenance.

Meanwhile, the fourth transfer module 41 may comprise an upper guide 410 and a lower guide 420 that define the sixth path 41*a*. The upper guide 410 may be rotatably connected to the lower guide 420 or the first frame 91.

Accordingly, the sixth path 41*a* may be opened by rotating the upper guide 410 in the first direction (in the counterclockwise direction in FIG. 4) in the state that the fourth transfer module 41 is exposed to the outside.

For another example, the upper guide 410 may comprise a plurality of guides, and rotate the whole of the plurality of guides in a first direction or a second direction that is opposite to the first direction. Alternatively, a portion of the plurality of guides may be rotated in the first direction, and another portion of the plurality of guides may be rotated in the second direction.

For yet another example, the fourth transfer module 41 may form a portion of the sixth path 41*a*, and each of the first transfer module 31, the discrimination module 25, the second transfer module 33 and the third transfer module 37 may define a portion of the sixth path 41*a*. In this case, when the second frame rotates in the first direction, the sixth path 41*a* may be opened.

Meanwhile, when rotating the second frame 92 with respect to the first frame 91, the fifth transfer module 42 and the sixth transfer module 43 are exposed to the outside so that the operator may access to a path defined by the fifth transfer module 42 and the sixth transfer module 43.

Here, in case that the sixth transfer module 43 is configured to form a path by two or more frames, the path may be opened by rotating a portion of the frames. Further, the medium disposed in the path that is not opened in the sixth transfer module 43 may be removed by operating a transfer unit such as a belt and a roller in the path using a manually operating device such as a knob.

The sixth transfer module 43 may be separated to open the path of the fifth transfer module 42.

When the fifth transfer module 42 is configured to define a path with two or more frames, the path may be opened by rotating a portion of the frames.

Further, the medium disposed in the path that is not opened in the fifth transfer module 42 may be removed by operating a transfer unit such as a belt and a roller in the path using a manually operating device such as a knob, without separating the sixth transfer module 43.

Figure 6:
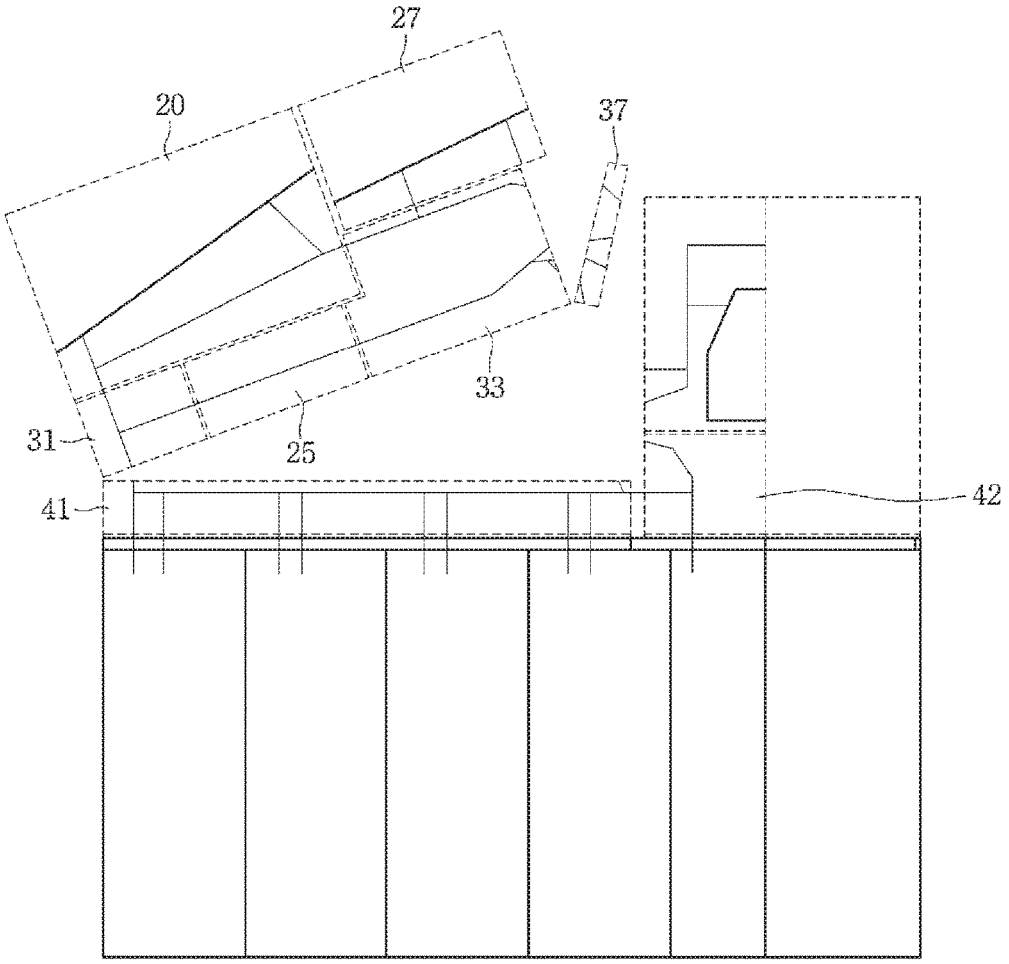
FIG. 6 is a view illustrating a state in which a path defined by a third transfer module is opened according to an embodiment.

FIG. 6 is a view illustrating a state in which a path defined by a third transfer module is opened according to an embodiment.

Referring to FIG. 6, in order to open a path defined by the third transfer module 37, the second frame 92 may be rotated with respect to the first frame 91. Here, the second frame 92 may be rotated in the state that the fifth transfer module 42, the sixth transfer module 43 and the additional function module 30 are not separated from the first frame 91. Alternatively, the second frame 92 may be rotated in the state that the fifth transfer module 42, the sixth transfer module 43 and the additional function module 30 are retreated in the first frame 91 in one direction (in the direction away from the second frame 92).

The second frame 92 is rotated in the first direction (in the counterclockwise direction in the drawing), the third transfer module 37 may be exposed to the outside, and the third transfer module 37 may be in a state to be rotated with respect to the second transfer module 31.

In this state, when rotating the third transfer module 37 in the second direction (in the clockwise direction in the drawing), the path defined by the third transfer module 37 may be opened.

Admittedly, a portion of the path defined by the third transfer module 37 (a plurality of connection paths 38 to 40) in the state that the third transfer module 37 is not rotated in the second direction, may be exposed to the outside.

Figure 7:
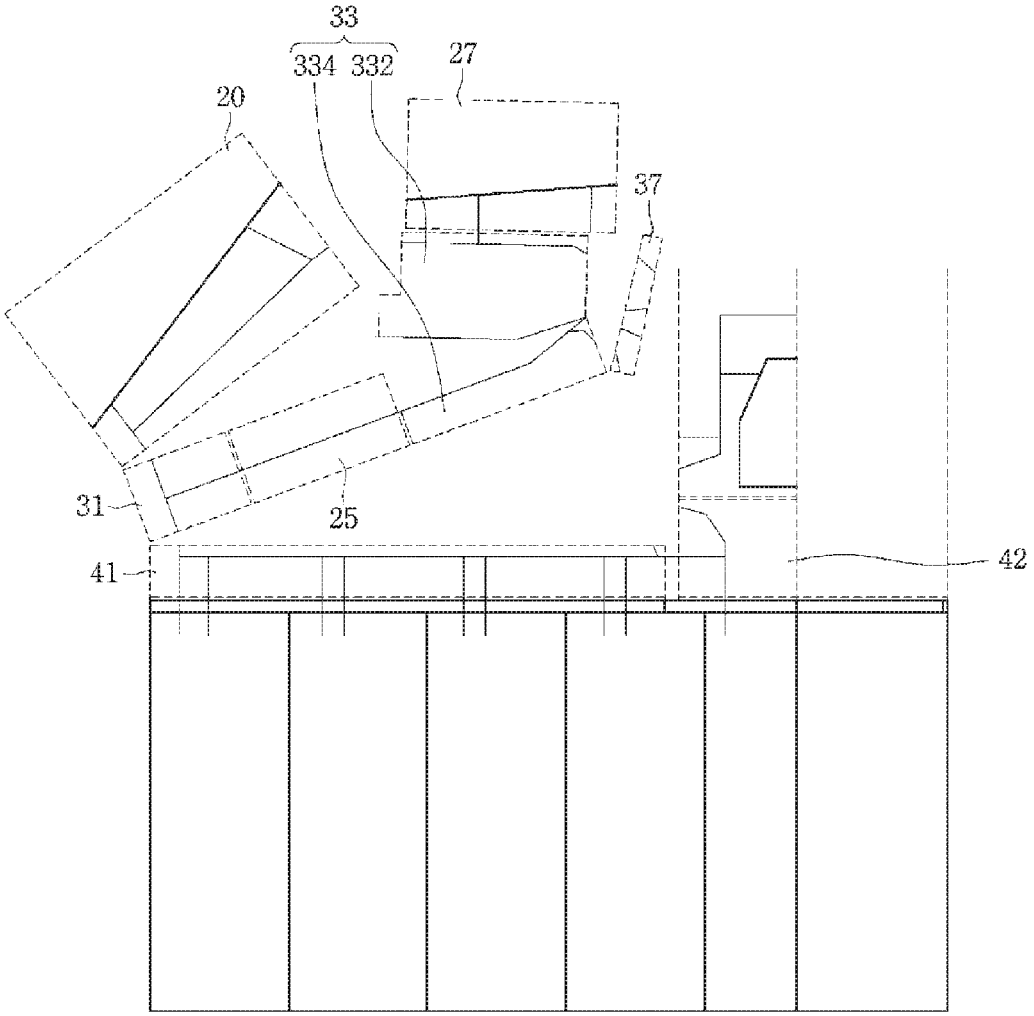
FIG. 7 is a view illustrating a state in which a portion of a path defined by a second transfer module is opened according to an embodiment.
Figure 8:
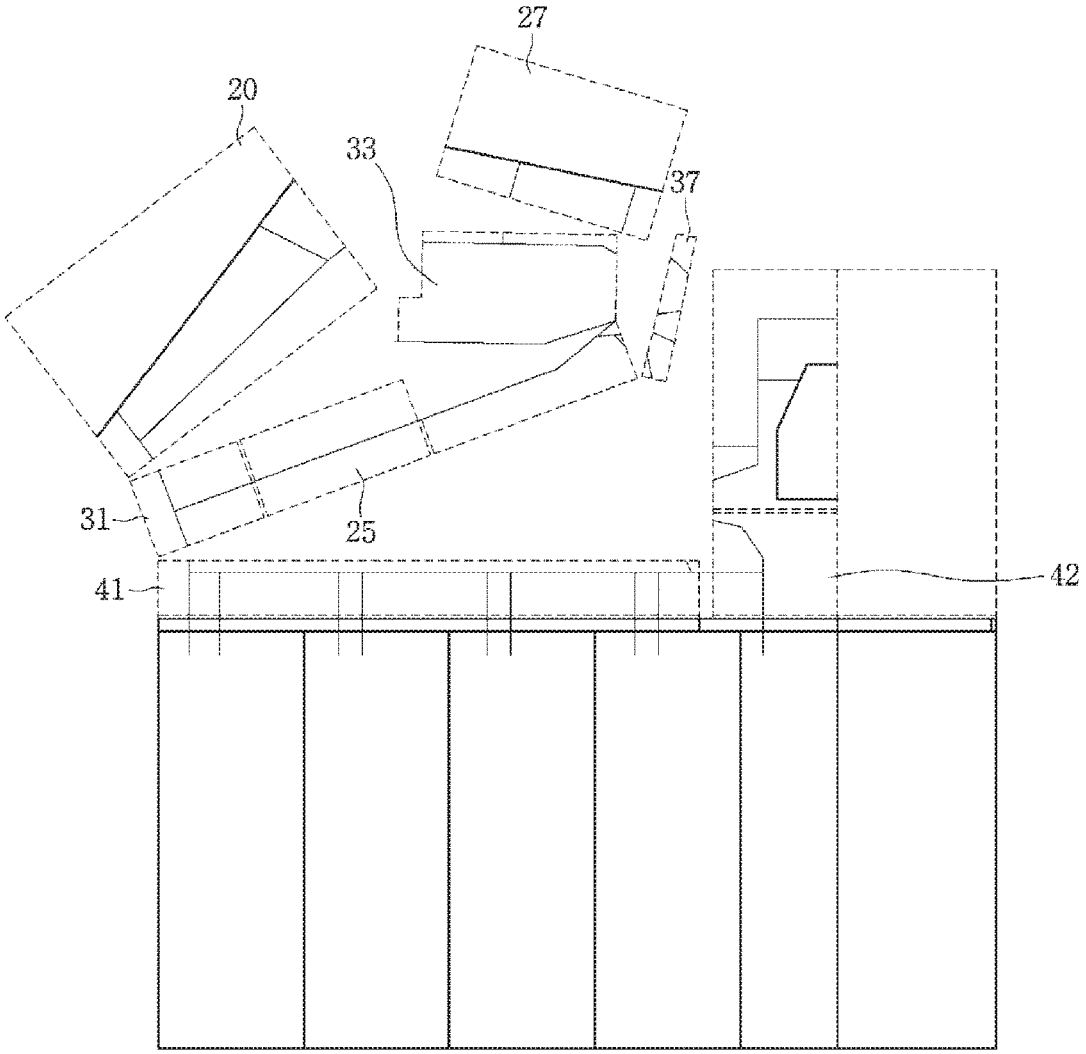
FIG. 8 is a view illustrating a state in which a portion of a path defined by a temporary staking module is opened according to an embodiment.

FIG. 7 is a view illustrating a state in which a portion of a path defined by a second transfer module is opened according to an embodiment, and FIG. 8 is a view illustrating a state in which a portion of a path defined by a temporary staking module is opened according to an embodiment.

Referring to FIGS. 7 and 8, the second transfer module 33 may comprise an upper guide 332 and a lower guide 334 to define the fourth path 34. That is, the fourth path 34 may be defined between the upper guide 332 and the lower guide 334. The upper guide 332 may be rotatably connected to the lower guide 334 or the second frame 92. Further, the upper guide 332 may define the fifth path 35.

The temporary staking module 27 may be rotatably connected to the second transfer module 33 or the second frame 92. Accordingly, the temporary staking module 27 may be rotatable with respect to the second transfer module 33.

The temporary staking module 27 and the upper guide 332 may be rotated together with respect to the lower guide 334. In this case, the temporary staking module 27 and the upper guide 332 may be connected together by a connection member (not shown) and keep their connection state. Further, when the connection made by the connection member is withdrawn, the temporary staking module 27 may be rotated with respect to the upper guide 332.

In order to open the path defined by the temporary staking module 27, the second frame 92 may be rotated with respect to the first frame 91. Here, the second frame 92 may be rotated in the state that the fifth transfer module 42, the sixth transfer module 43 and the additional function module 30 are not separated from the first frame 91. When the second frame 92 is rotated in the first direction (in the counterclockwise direction in the drawing), the temporary staking module 27 is in a rotatable state.

When the sixth transfer module 43 is separated from the second frame 92, the temporary staking module 27 may be rotated in the second direction without rotating the second frame 92.

When rotating the temporary staking module 27 in the second direction (in a clockwise direction in the drawing) in this state, the path defined by the temporary staking module 27 (a portion of at least one of an introduction path 28 and a withdrawal path 29, for example) may be opened. Here, when rotating the temporary staking module 27, the path defined by the second transfer module 33 (the fifth path 35, for example) may also be opened together.

In order to the path defined by the second transfer module 33 (the fourth path 34, for example), the second frame 92 may be rotated with respect to the first frame 91. Here, the second frame 92 may be rotated in the state that the fifth transfer module 42, the sixth transfer module 43 and the additional function module 30 are not separated from the first frame 91.

Further, when rotating the medium depositing and withdrawing module 20 in the first direction (in the counterclockwise direction in the drawing), the upper guide 332 may be in a rotatable state. When rotating the upper guide 332 in the second direction (in the clockwise direction in the drawing) in this state, a portion of the path defined by the upper guide 332 and the lower guide 334 and the path defined by the discrimination module 25 may be opened. In the case that the discrimination module is configured to define a path by a plurality of guides, the path may be opened by rotating a portion of the guides.

According to current embodiment described above, since it is not needed to disassemble each module to maintain it, the working efficiency may be increased and the maintenance time may be reduced.

Figure 9:
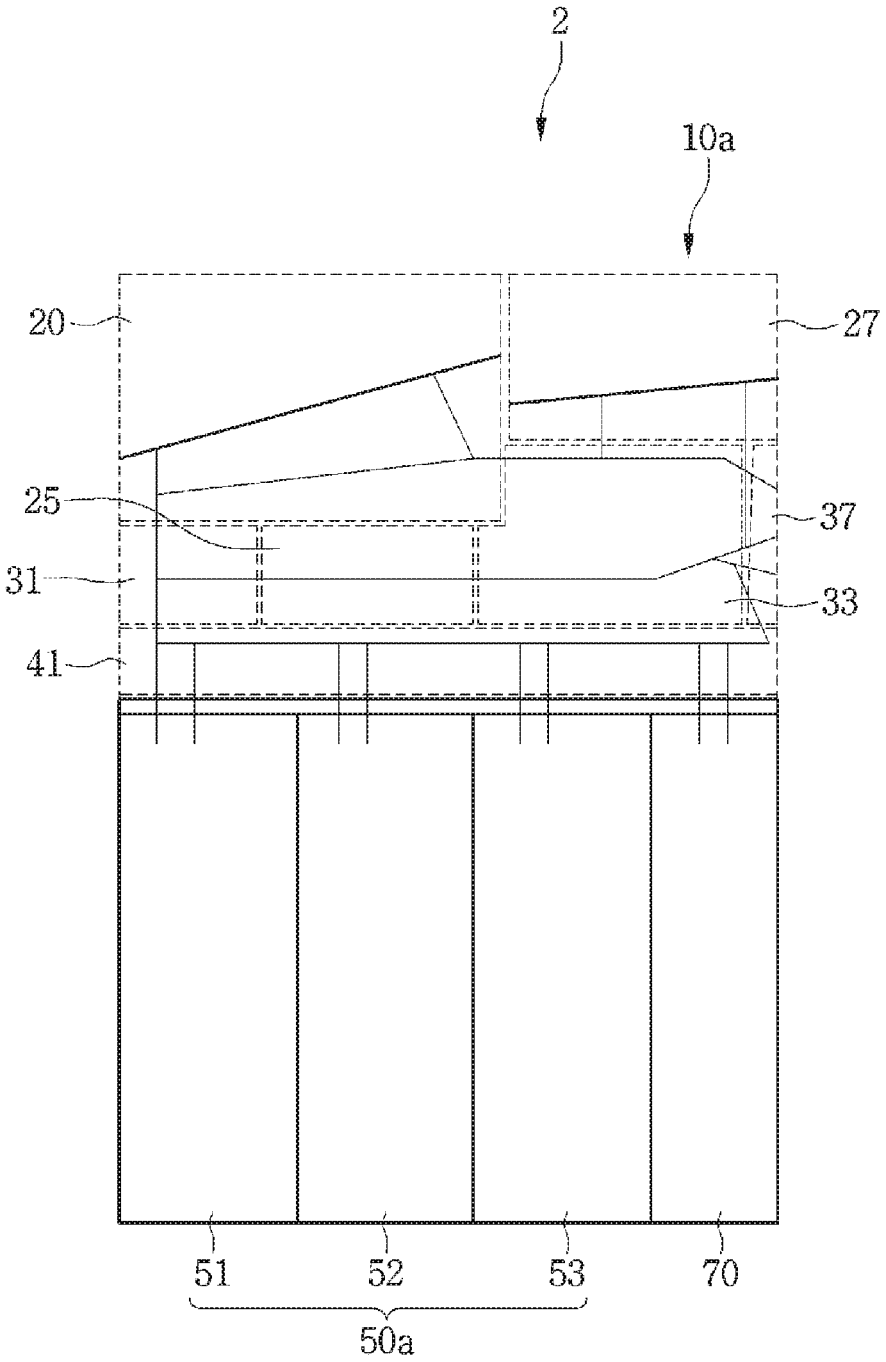
FIG. 9 is a view illustrating a state in which the financial device of FIG. 1 is deformed in a second configuration.

FIG. 9 is a view illustrating a state in which the financial device of FIG. 1 has been transformed to a second configuration.

Referring to FIG. 9, a financial device 2 having a second configuration may comprise a medium processing apparatus 10*a* having a second configuration.

The medium processing apparatus 10*a* having a second configuration may commonly comprise at least the medium depositing and withdrawing module 20, the first transfer module 31, the discrimination module 25, the second transfer module 33, the third transfer module 37, the fourth transfer module 41 and the temporary staking module 27 among the modules that configure the medium processing apparatus 10 having a first configuration.

Additionally, the medium processing apparatus 10*a* may further comprise a medium storage unit 150*a* and a collection module 70.

Here, the collection module 70 may be identical to the collection module 70 disclosed in FIG. 1 or be different from that. When the collection module 70 in FIG. 9 is identical to the collection module 70 in FIG. 1, the collection module 70 may comprise a box defining a configuration, the box having a medium opening on the side surface and the upper side to pass the medium.

On the other hand, when the collection module 70 in FIG. 9 and the collection module 70 in FIG. 1 are different with each other, the collection module 70 in FIG. 9 may have the medium opening disposed on the upper side of the box, and the collection module 70 in FIG. 1 may have the medium opening disposed on the side surface of the box.

The medium storage unit 50*a* may comprise a plurality of medium storage modules 51 to 53.

The financial device having the second configuration disclosed in FIG. 9 may be a downsized one for the financial device having the first configuration disclosed in FIG. 1. Accordingly, the number of the medium storage modules 51 to 53 configuring the medium storage unit 50*a* disclosed in FIG. 9 may be smaller than that of the medium storage modules 51 to 54 configuring the medium storage unit 50 disclosed in FIG. 1.

In case of the medium processing apparatus 10*a* having the second configuration, the third transfer module 37 may directly transfer the medium to the fourth transfer module 41.

In summary, the financial device having the second configuration may have a configuration in which the fifth to seventh transfer modules and the additional function module are removed from the financial device having the first configuration.

In this specification, accordingly, the medium depositing and withdrawing module 20, the first transfer module 31, the discrimination module 25, the second transfer module 33, the third transfer module 37, the fourth transfer module 41, the temporary staking module 27 and at least one medium storage module may be common modules configuring a customer financial device regardless of its configuration.

For a deposit transaction, the medium put into the medium depositing and withdrawing module 20 may be transferred to the discrimination module 25 by the first transfer module 31. The medium that passes through the discrimination module 25 may be transferred to the temporary staking module 27 by the second and third transfer modules 33 and 37. The medium that is determined as the abnormal medium by the discrimination module 25 or the medium that is not recognized by the discrimination module 25 may be transferred to the medium depositing and withdrawing module 20 by the second transfer module 33 and the third transfer module 37.

When the first deposit process is completed, a deposit confirmation command or a deposit cancel command with respect to the medium stacked in the temporary staking module 27 may be received through the user interface 16. If the deposit confirmation command is received through the user interface 16, the medium stacked in the temporary staking module 27 may be transferred to the second transfer module 33.

The medium transferred to the second transfer module 33 passes through the path defined by the medium depositing and withdrawing module 20 and then passes again through the discrimination module 25 via the first transfer module 31. The medium that passes again through the discrimination module 25 may pass through the second transfer module 33 and the third transfer module 37, and be transferred to the fourth transfer module 41.

The medium that is determined as the normal medium among the media that pass again through the discrimination module 25 may be finally inserted into the medium storage unit 50*a* by the fourth transfer module 41. On the other hand, the medium that is determined as a medium, which is unsuitable to be stored in the medium storage unit 50*a*, of the media which pass again through the discrimination module 25 may be transferred to the collection module 76 by the fourth transfer module 41.

When the medium withdrawal command is received through the user interface 16, a kind and the number of medium corresponding to the received sum of the medium to be withdrawn may be discharged from the medium storage unit 50*a*. The medium discharged from the medium storage unit 50*a* may be transferred along the fourth transfer module 41, and then passes through the discrimination module 25 via the first transfer module 31.

The medium determined as the normal medium among the media passing through the discrimination module 25 may be withdrawn to the medium depositing and withdrawing module 20 by the second and third transfer modules 33 and 37. On the other hand, the medium that is determined as the abnormal medium or the medium that is not recognized by the discrimination module 25 among the media passing through the discrimination module 25 may be transferred to the fourth transfer module 41 via the second and third transfer modules 33 and 37, and then finally transferred to the collection module 70.

Meanwhile, since the configuration to maintain the common module in this embodiment is identical to the configuration to maintain the modules described in the medium processing apparatus having the first configuration, a detailed description will be omitted.

Figure 10:
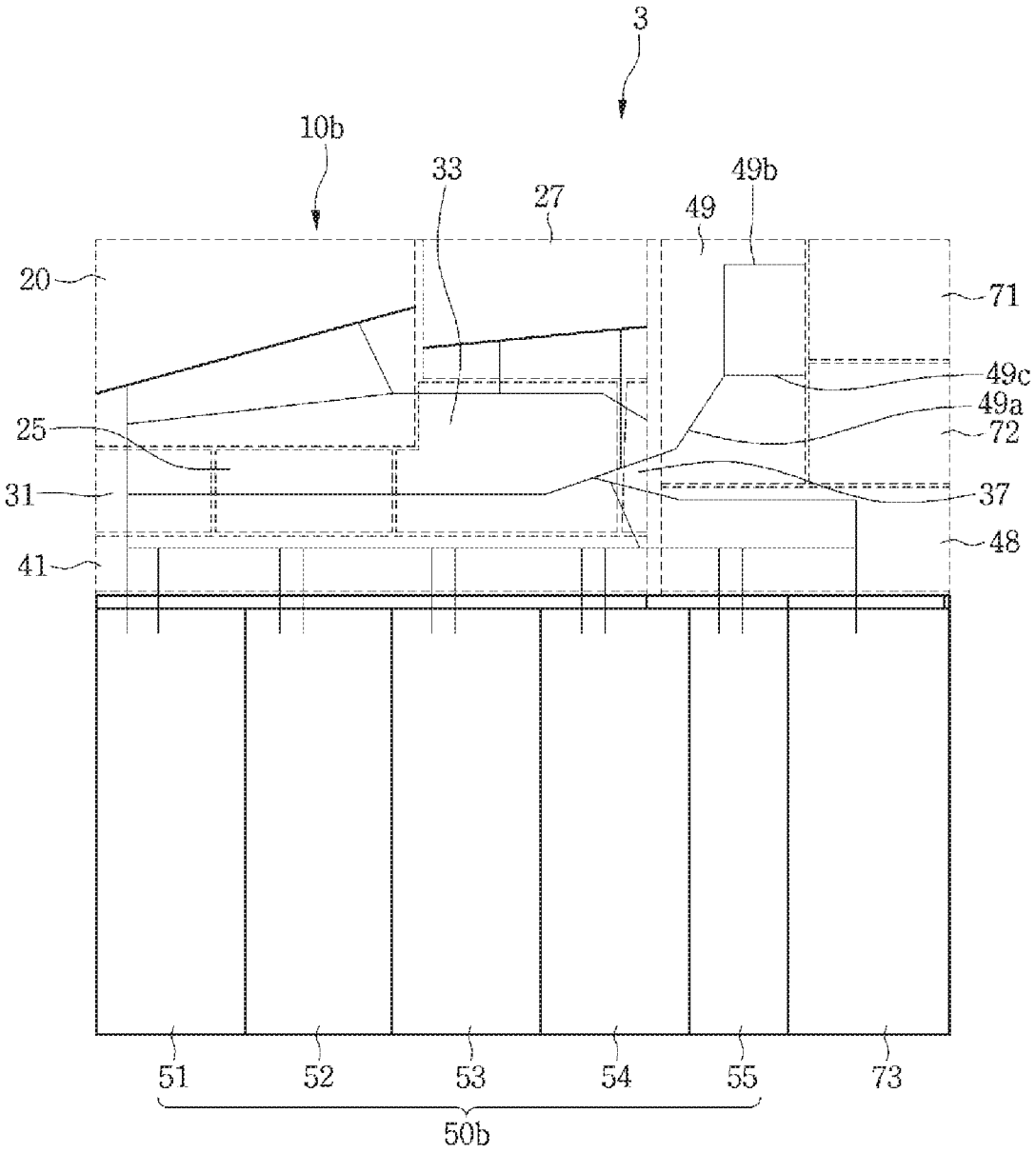
FIG. 10 is a view illustrating a state in which the financial device of FIG. 1 is deformed in a third configuration.

FIG. 10 is a view illustrating a state in which the financial device of FIG. 1 has been transformed to a third configuration.

Referring to FIG. 10, a financial device 3 having a third configuration may comprise a medium processing apparatus 10*b* having a third configuration.

The medium processing apparatus 10*b* having the third configuration may comprise the medium depositing and withdrawing module 20, the first transfer module 31, the discrimination module 25, the second transfer module 33, the third transfer module 37, the fourth transfer module 41, and the temporary staking module 27, which are the common modules.

Also, the medium processing apparatus 10*b* may further comprise a medium storage unit 50*b* and a plurality of collection modules 71 to 73.

The number of medium storage modules 51 to 55 constituting the medium storage unit 50*b* may be greater than that of the medium storage modules 51 to 54 constituting the medium storage unit 50 disclosed in FIG. 1.

Accordingly, the financial device having the third configuration may process more kinds of media than those of media to be processed by the financial device having the first configuration.

The medium processing apparatus 10*b* may further comprise an eighth transfer module 48 for transferring a medium transferred from the third transfer module 37 to the fourth transfer module 41.

The plurality of collection modules 71 to 73 may comprise a first collection module 71, a second collection module 72, and a third collection module 73.

A medium that is not received in the withdrawal transaction process may be transferred to one of the first and second collection modules 71 and 72, and a medium that is not received despite its return in the deposit transaction process may be transferred to the other one of the first and second collection modules 71 and 72. Alternatively, the non-receipt medium may be stored in a single collection module. Alternatively, a plurality of collection spaces may be divided in the single collection module.

A medium that is determined as the abnormal medium by the discrimination module 25 or a medium that is not recognized by the discrimination module 25 may be stored in the third collection module 73.

The medium processing apparatus 10*b* may further comprise a ninth transfer module 49 for transferring the non-receipt medium to the first collection module 71 and the second collection module 72.

The ninth transfer module 49 may be disposed above the eighth transfer module 48 and at a rear side of the temporary staking module 27 to vertically overlap with at least a portion of the eighth transfer module 48.

The ninth transfer module 49 may be disposed between the temporary staking module 27 and the first collection module 71.

Also, the ninth transfer module 49 may be disposed between the third transfer module 37 and the second collection module 72.

The eighth transfer module 48 may be disposed under the second collection module 72 and above the third collection module 73. That is, at least a portion of the eighth transfer module 48 may be disposed between the first or second collection module 71 or 72 and the third collection module 73.

Also, the eighth transfer module 48 may be disposed to vertically overlap with at least one medium storage module 55. Also, the eighth transfer module 48 may be disposed to vertically overlap at least a portion of the third collection module 73.

The ninth transfer module 49 may comprise a common path 49*a* and first and second branch paths 49*b* and 49*c* branched from the common path 49*a*.

The first branch path 49*b* may be connected to the first collection module 71, and the second branch path 49*c* may be connected to the second collection module 72.

In order to process a deposit transaction, the medium accepted into the medium depositing and withdrawing module 20 may be transferred to the discrimination module 25 via the first transfer module 31. The medium that is determined as the normal medium by the discrimination module 25 may be transferred to the temporary staking module 27 by the second transfer module 33 and the third transfer module 37. On the other hand, the medium that is determined as the abnormal medium by the discrimination module 25 or the medium that is not recognized by the discrimination module 25 may be transferred to the medium depositing and withdrawing module 20 by the second transfer module 33 and the third transfer module 37.

When the first deposit process is completed, a deposit confirmation command or a deposit cancel command with respect to the medium stacked in the temporary staking module 27 may be received through the user interface 16.

If the deposit confirmation command is received through the user interface 16, the medium stacked in the temporary staking module 27 may be transferred to the second transfer module 33. The medium transferred to the second transfer module 33 passes through the third path defined by the medium depositing and withdrawing module 20, and passes again through the discrimination module 25 via the first transfer module 31.

The medium that passes again through the discrimination module 25 may be transferred to the eighth transfer module 48 via the second and third transfer modules 33 and 37. The medium that is determined as the normal medium among the media that pass again through the discrimination module 25, according to its kind of medium, is directly transferred to the fifth medium storage module 55 by the eighth transfer module 48, or is transferred to the fourth transfer module 41 by the eighth transfer module 48 and then transferred to any one module of the first to fourth medium modules 51 to 54 by the eighth transfer module 48.

On the other hand, the medium that is determined as a medium, which is unsuitable to be stored in the medium storage unit, of the media passing again through the discrimination module 25 may be transferred to the third collection module 73 by the eighth transfer module 48.

When the medium withdrawal command is received through the user interface 16, a kind and the number of medium corresponding to the received sum of the medium to be withdrawn may be discharged from the medium storage unit 50*b*. The medium discharged from the fifth medium storage module 55 among the medium discharged from the medium storage unit 50*b* is transferred to the fourth transfer module 41 via the eighth transfer module 48. The medium discharged from at least one of the first to fourth medium storage modules 51 to 54 among the media discharged from the medium storage unit 50*b* may be directly transferred to the fourth transfer module 41. The medium transferred to the fourth transfer module 41 may pass through the discrimination module 25 via the first transfer module 31.

The medium determined as the normal medium among the media passing through the discrimination module 25 may be withdrawn to the medium depositing and withdrawing module 20 by the second and third transfer modules 33 and 37. On the other hand, the medium that is determined as the abnormal medium or the medium that is not recognized by the discrimination module 25 among the media passing through the discrimination module 25 may be transferred to the eighth transfer module 48 via the second and third transfer modules 33 and 37. Also, the medium transferred to the eighth transfer module 48 may be finally transferred to the third collection module 73.

Meanwhile, since the configuration to maintain the common module in this embodiment is identical to the configuration to maintain the modules described in the medium processing apparatus having the first configuration, a detailed description will be omitted.

The eighth transfer module 48 may be installed in the first frame (referring to 91 in FIG. 3).

In order to maintain the eighth transfer module 48, the second frame (referring to 92 in FIG. 3) may be rotated with respect to the first frame (referring to 91 in FIG. 3), or the ninth transfer module 49 and the collection modules 71 and 72 that are disposed above the eighth transfer module 48 may be separated.

In order to maintain the ninth transfer module 49, the second frame (referring to 92 in FIG. 3) may be rotated with respect to the first frame (referring to 91 in FIG. 3), or the collection modules 71 and 72 may be separated.

Here, when opening the path comprised in each module, the medium in the path may be removed using the manually operating device such as a knob in the state that the whole of each path is opened to the outside or only a portion of the path (inlet or outlet, for example) is opened to the outside.

Figure 11:
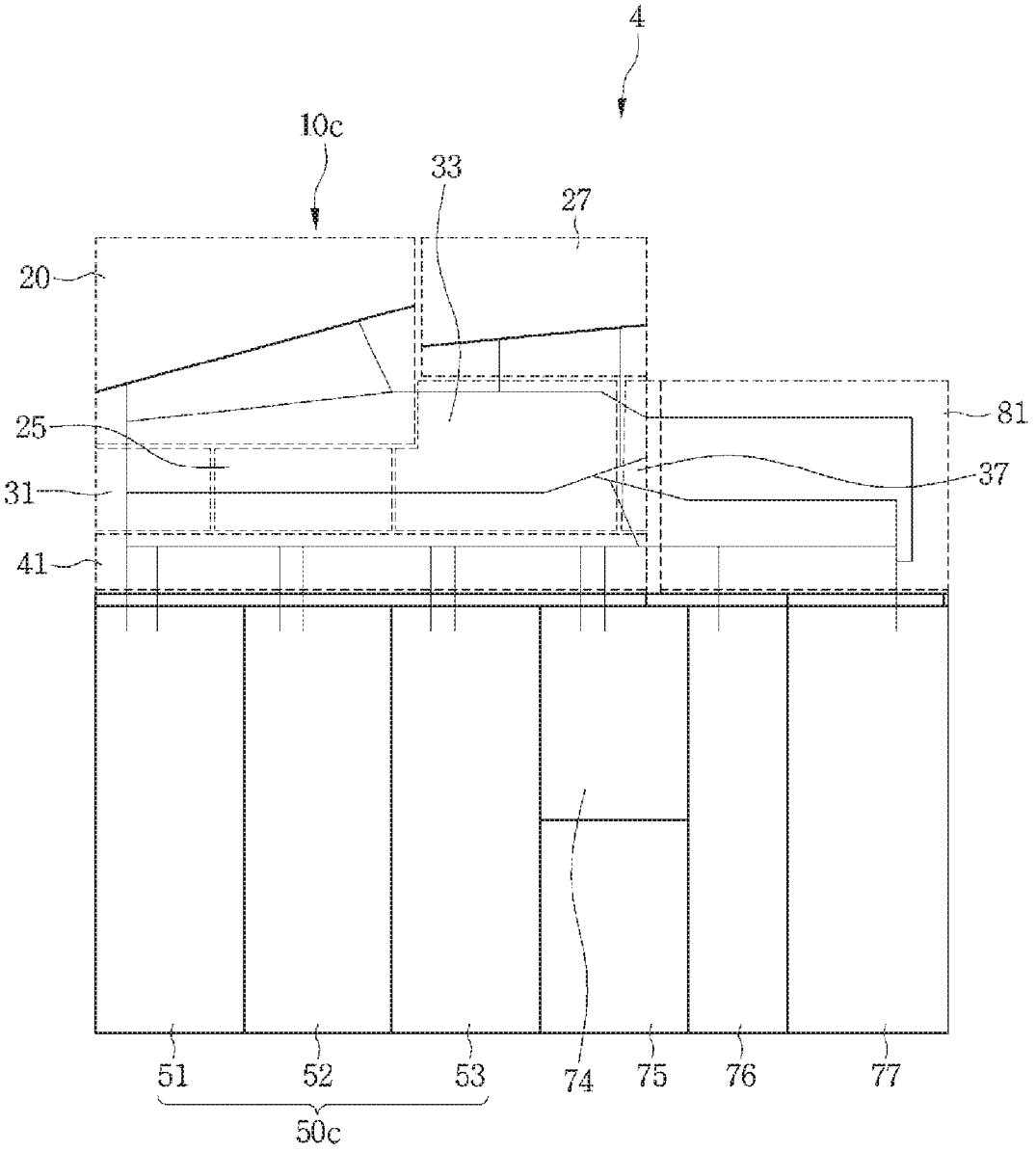
FIG. 11 is a view illustrating a state in which the financial device of FIG. 1 is deformed in a fourth configuration.

FIG. 11 is a view illustrating a state in which the financial device of FIG. 1 has been transformed to a fourth configuration.

Referring to FIG. 11, a financial device 4 having a fourth configuration may comprise a medium processing apparatus 10*c* having a fourth configuration.

The medium processing apparatus 10*c* having the fourth configuration may comprise the medium depositing and withdrawing module 20, the first transfer module 31, the discrimination module 25, the second transfer module 33, the third transfer module 37, the fourth transfer module 41, and the temporary staking module 27, which are the common modules.

Also, the medium processing apparatus 10*c* may further comprise the medium storage unit 50*c* and at least one collection module.

The number of the medium storage modules 51 to 53 constituting the medium storage unit 50*c* may be smaller than that of the medium storage modules 51 to 54 constituting the medium storage unit 50 disclosed in FIG. 1.

The medium processing apparatus 10*c* may further comprise a tenth transfer module 81 for transferring a medium transferred from the third transfer module 37 to the fourth transfer module 41.

The at least one collection module may comprise a first collection module 74, a second collection module 75, and a third collection module 76, but not limited thereto.

The first collection module 74 and the second collection module 75 may be vertically arranged. Also, each of the first and second collection modules 74 and 75 may be horizontally arranged with respect to the third collection module 76.

The medium processing apparatus 10*c* may further comprise an additional function module 77 for storing at least one medium of a medium to be replenished and a collected medium.

The additional function module 77 may be horizontally arranged with respect to the third collection module 76.

The tenth transfer module 81 may be disposed above at least one collection module 76 and the additional function module 77 to vertically overlap with at least a portion of each of the at least one collection module 76 and the additional function module 77.

The tenth transfer module 81 may directly transfer the medium transferred from the third transfer module 37 to the additional function module 77 or directly transfer the medium transferred from the additional function module 77 to the third transfer module 37.

The medium that is not received in the withdrawal transaction process may be stored in one of the plurality of collection modules 74 to 76, and a medium which is not received despite its return in the deposit transaction process may be stored in another collection module. Also, a medium that is determined as the abnormal medium or a medium that is not recognized by the discrimination module 25 may be stored in further another collection module.

In order to process the deposit transaction, the medium accepted into the medium depositing and withdrawing module 20 may be transferred to the discrimination module 25 via the first transfer module 31.

The medium that is determined as the normal medium by the discrimination module 25 may be transferred to the temporary staking module 27 by the second and third transfer modules 33 an 37. On the other hand, the medium that is determined as the abnormal medium or the medium that is not recognized by the discrimination module 25 may be transferred to the medium depositing and withdrawing module 20 by the second and third transfer module 33 and 37.

When the first deposit process is completed, the deposit confirmation command or deposit cancel command with respect to the medium stored in the temporary staking module 27 may be received through the user interface 16.

If the deposit confirmation command is received through the user interface 16, the medium stacked in the temporary staking module 27 may be transferred to the second transfer module 33. The medium transferred to the second transfer module 33 passes through the third path defined by the medium depositing and withdrawing module 20, and then passes again through the discrimination module 25 via the first transfer module 31.

The medium that passes through the discrimination module 25 may be transferred to the tenth transfer module 81 via the second and third transfer modules 33 and 37.

The medium that is determined as the normal medium, of the media that pass again through the discrimination module 25 may be transferred to the fourth transfer module 41 from the tenth transfer module 81 and then transferred to any one module of the first to third medium storage modules 51 to 53.

On the other hand, the medium that is determined as the medium, which is unsuitable to be stored in the medium storage unit, of the media which pass again through the discrimination module 25 may be transferred to the third collection module 76 by the tenth transfer module 81, or transferred to the fourth transfer module 41 from the tenth transfer module 81 and then transferred to the first or second collection module 74 or 75.

When the medium withdrawal command is received through the user interface 16, a kind and the number of medium corresponding to the received sum of the medium to be withdrawn may be discharged from the medium storage unit 50*c*. The medium discharged from the medium storage unit 50*c* may be transferred to the first transfer module 31 via the forth transfer module 41. The medium transferred to the first transfer module 31 passes through the discrimination module 25.

The medium determined as the normal medium among the media passing through the discrimination module 25 may be withdrawn to the medium depositing and withdrawing module 20 by the second and third transfer modules 33 and 37. On the other hand, the medium that is determined as the abnormal medium or the medium that is not recognized by the discrimination module 25 among the media passing through the discrimination module 25 may be transferred to the tenth transfer module 81 via the second and third transfer modules 33 and 37. Further, the medium that is transferred to the tenth transfer module 81 may be directly transferred to the third collection module 76, or transferred to the first or second collection module 74 or 75 via the fourth transfer module 41, depending on the kind of the medium transferred to the tenth transfer module 81.

Meanwhile, since the configuration to maintain the common modules in this embodiment is identical to the configuration to maintain modules described in the medium processing apparatus having the first configuration, a detailed description will be omitted.

The tenth transfer module 81 may be installed in the first frame (referring to 91 in FIG. 3).

In order to maintain the tenth transfer module 81, the second frame (referring to 92 in FIG. 3) may be rotated with respect to the first frame (referring to 91 in FIG. 3), or the tenth transfer module 81 may be rotated with respect to the first frame (referring to 91 in FIG. 3).

Further, a portion of the path may be opened by rotating the tenth transfer module 81 in the clockwise direction in the drawing, independently of the first and second frames. Here, the medium disposed in the path that is not opened may be removed by operating a transfer unit such as a belt or a roller in the path using a manually operating device such as a knob.

Figure 12:
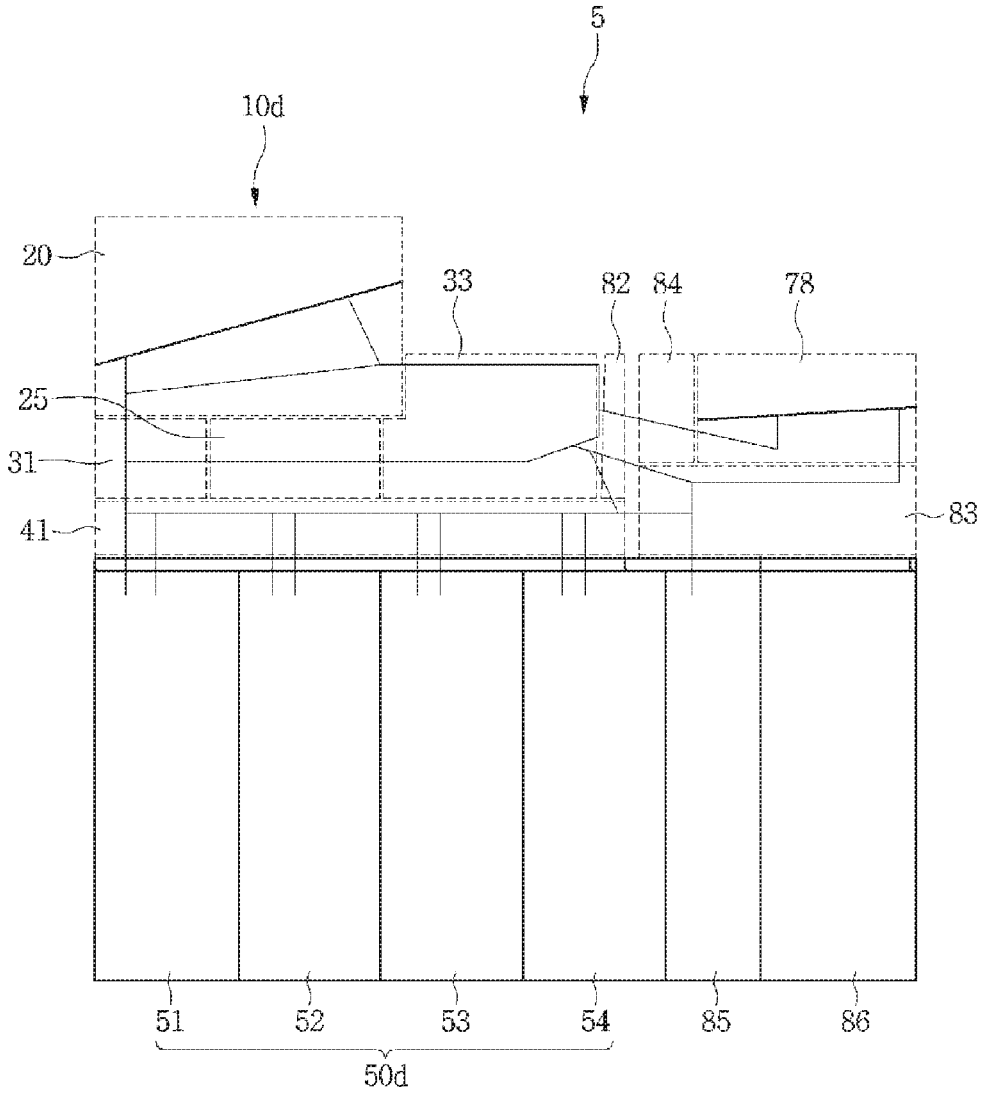
FIG. 12 is a view illustrating a state in which the financial device of FIG. 1 is deformed in a fifth configuration.

FIG. 12 is a view illustrating a state in which the financial device of FIG. 1 has been transformed to a fifth configuration.

Referring to FIG. 12, a financial device 5 having a fifth configuration may comprise a medium processing apparatus 10*d* having a fifth configuration.

The financial device having the fifth configuration may be a teller or manager financial device that is transformed from the customer financial device having the first configuration.

The medium processing apparatus 10*d* having the fifth configuration may comprise the medium depositing and withdrawing module 20, the first transfer module 31, the discrimination module 25, the second transfer module 33, and the fourth transfer module 41 of the common modules.

Further, the medium processing apparatus 10*d* may further comprise a medium storage unit 50*d* and a temporary stacking module 78.

The medium processing apparatus 10*d* may further comprise an eleventh transfer module 82, a twelfth transfer module 83 and a thirteenth transfer module 84.

The eleventh transfer module 82 may be disposed at a rear side of the second transfer module 33, the thirteenth transfer module 84 may be disposed at a rear side of the eleventh transfer module 82, and the temporary staking module 78 may be disposed at a rear side of the thirteenth transfer module 84.

The eleventh transfer module 82 may be disposed above the fourth transfer module 41, to vertically overlap with at least a portion of the fourth transfer module 41.

The twelfth transfer module 83 may be disposed under the thirteenth transfer module 84 and the temporary staking module 78.

At least a portion of each of the thirteenth transfer module 84 and the temporary staking module 78 may be disposed to vertically overlap the twelfth transfer module 83.

The medium processing apparatus 10*d* may further comprise a collection module 86 to collect the medium determined as an abnormal medium and the medium that is not recognized in the determination module, and a fourteenth module 85 that guides the medium transferred by the twelfth transfer module 83 to the collection module 86.

The fourteenth transfer module 85 and the collection module 86 may be disposed under the twelfth transfer module 83, and at least a portion of each of the fourteenth transfer module 85 and the collection module 86 may be disposed to vertically overlap the twelfth transfer module 83.

Further, the fourteenth transfer module 85 and the collection module 86 may be arranged in the horizontal direction with respect to the plurality of medium storage modules 51 to 54.

In order to process the deposit transaction, the medium accepted into the medium depositing and withdrawing module 20 may be transferred to the discrimination module 25 via the first transfer module 31.

The medium that is determined as the normal medium by the discrimination module 25 may be transferred to the temporary staking module 78 by the second transfer module 33, the eleventh transfer module 82, and the twelfth transfer module 83. On the other hand, the medium that is determined as the abnormal medium by the discrimination module 25 or the medium that is not recognized by the discrimination module 25 may be transferred to the medium depositing and withdrawing module 20 by the second transfer module 33 and the eleventh transfer module 82.

When the first deposit process is completed, the deposit confirmation command or the deposit cancel command with respect to the medium stacked in the temporary staking module 78 may be received through the user interface 16.

If the deposit confirmation command is received through the user interface 16, the medium stacked in the temporary staking module 78 may be transferred to the second transfer module 33 by the thirteenth transfer module 84 and the eleventh transfer module 82. The medium transferred to the second transfer module 33 passes through the path defined by the medium depositing and withdrawing module 20, and then passes again through the discrimination module 25 via the first transfer module 31.

The medium passing through the discrimination module 25 passes through the second and eleventh transfer modules 33 an 82 and then is transferred to the twelfth transfer module 83.

The medium that is determined as a medium, which is unsuitable to be stored in the medium storage unit, of the media that pass again through the discrimination module 25 may be transferred to the fourth transfer module 41 from the twelfth transfer module 83 and then transferred to any one module of the first to fourth medium storage modules 51 to 54. On the contrary, the medium determined as the abnormal medium or the medium that is not recognized among the media that pass again through the discrimination module 25, may be transferred to the fourteenth transfer module 85 from the twelfth transfer module 83, and then finally transferred to the collection module 86.

When the medium withdrawal command is received through the user interface 16, a kind and the number of the medium corresponding to the received sum of the medium to be withdrawn may be discharged from a medium storage unit 50*d*. The medium discharged from the medium storage unit 50*d* may be transferred to the first transfer module 31 via the fourth transfer module 41. The medium transferred to the first transfer module 31 may pass through the discrimination module 25.

The medium determined as the normal medium among the media passing through the discrimination module 25 may be withdrawn to the medium depositing and withdrawing module 20 by the second and eleventh transfer modules 33 and 82.

On the other hand, the medium that is determined as the abnormal medium or the medium that is not recognized by the discrimination module 25 among the media passing through the discrimination module 25 may be transferred to the collection module 86 via the second, eleventh, twelfth, and fourteenth transfer modules 33, 82, 83, and 85.

Meanwhile, since the configuration to maintain the common modules in this embodiment is identical to the configuration to maintain the modules described in the medium processing apparatus having the first configuration, a detailed description will be omitted.

Further, the configuration to maintain the eleventh transfer module 82 may be identical to the configuration to maintain the third transfer module described in the medium processing apparatus having the first configuration.

The thirteenth transfer module 83 may be installed in the first frame (referring to 91 in FIG. 3) or in an independent frame.

In order to maintain the thirteenth transfer module 83 and the fourteenth transfer module 84, the second frame (referring to 92 in FIG. 3) may be rotated with respect to the first frame (referring to 91 in FIG. 3).

Alternatively, a portion of the path within the thirteenth transfer module 83 and the fourteenth transfer module 84 may be opened by rotating the thirteenth transfer module 83 together with the fourteenth transfer module 84 and the temporary staking module 78 in the clockwise direction in the drawing (in the second direction), independently of the first and second frames. Here, the medium disposed in the path that is not opened may be removed by operating a transfer unit such as a belt or a roller in the path using a manually operating device such as a knob.

In order to maintain the temporary staking module 78, a portion of the path within the temporary staking module 78 may be opened by separating the temporary staking module 78 or rotating the temporary staking module 78 with respect to the thirteen transfer module 84 by a predetermined angle in the clockwise direction in the drawing (in the second direction).

Although the second transfer module and the third transfer module are provided as separate modules in the foregoing description, the second transfer module and the third transfer module may be provided as a single module.

Thus, the second transfer module and the third transfer module may be commonly called a first connection module. Also, the fourth transfer module may be called a second connection module connected to the medium storage unit.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or includes or has) some elements, it should be understood that it may comprise (or include or have) only those elements, or it may comprise (or include or have) other elements as well as those elements if there is no specific limitation. Unless otherwise specifically defined herein, all terms including technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

What is claimed is:

1. A financial device comprising:

a medium depositing and withdrawing module having a medium storing space to store a medium;

a discrimination module to discriminate the medium;

a first transfer module to guide the medium of the medium depositing and withdrawing module to the discrimination module;

a temporary staking module in which a medium to be withdrawn, which passes through the discrimination module, is temporarily stacked;

a first connection module to transfer a medium between the discrimination module and the temporary staking module;

a medium storage unit to store a medium to be deposited and a medium to be withdrawn;

a second connection module to guide a medium passing through the first connection module to the medium storage unit;

a first frame in which the second connection module is installed; and a second frame in which the first connection module and the discrimination module are installed, and which is connected rotatably to the first frame, wherein, when rotating the second frame with respect to the first frame, the second connection module is exposed, wherein the first connection module comprises a second transfer module to which a medium is transferred from the discrimination module, and a third transfer module which connects the second transfer module and the temporary stacking module with each other or the second transfer module and the second connection module with each other, and wherein a portion of the second transfer module or the entire second transfer module is rotatably installed in the second frame, and a portion or the entire third transfer module is rotatably installed in the second frame.

2. The financial device of claim 1, wherein the second connection module is separated from the first frame when the second frame is rotated with respect to the first frame.

3. The financial device of claim 2, wherein the medium storage unit is disposed under the second connection module.

4. The financial device of claim 1, wherein the second connection module comprises an upper guide and a lower guide to define a path, the second frame is rotated with respect to the first frame in a first direction for maintenance, and an upper guide of the second connection module is rotated to open the path.

5. The financial device of claim 4, wherein the upper guide is rotated with respect to the lower guide in the first direction.

6. The financial device of claim 1, wherein the medium depositing and withdrawing module is disposed above the first transfer module and the discrimination module, and rotatably connected to the first transfer module or the second frame.

7. The financial device of claim 6, wherein the first connection module is installed in the second frame, and the temporary stacking module is disposed above the first connection module and rotatably connected to the first connection module or the second frame.

8. The financial device of claim 7, wherein the medium depositing and withdrawing module is rotated in a first direction for maintenance, and the temporary stacking module is rotated in a second direction which is opposite to the first direction.

9. The financial device of claim 7, wherein the second frame is rotated in a first direction with respect to the first frame for maintenance, and wherein the third transfer module is rotated in a second direction which is opposite to the first direction for maintenance.

10. The financial device of claim 9, wherein the second transfer module comprises an upper guide and a lower guide to define a path, and the upper guide is rotated in the second direction to open the path.

11. The financial device of claim 10, wherein the temporary stacking module is rotated in the second direction with respect to the upper guide.

12. The financial device of claim 1, wherein the first frame is installed with one or more additional transfer modules and a storage module to replenish or collect a medium.

13. A financial device comprising:

a medium depositing and withdrawing module having a medium storing space to store a medium;

a discrimination module to discriminate the medium;

a first transfer module to guide the medium of the medium depositing and withdrawing module to the discrimination module;

a temporary stacking module in which a medium to be withdrawn, which passes through the discrimination module, is temporarily stacked;

a first connection module to transfer a medium between the discrimination module and the temporary stacking module;

a medium storage unit to store a medium to be deposited and a medium to be withdrawn; and a second connection module to guide a medium passing through the first connection module to the medium storage unit, wherein, when the medium depositing and withdrawing module, the discrimination module, the first transfer module, the temporary stacking module, and the first connection module are rotated with respect to the second connection module in a first direction in a state of defining a path thereof, the second connection module is exposed, wherein the first connection module comprises a second transfer module to which a medium is transferred from the discrimination module, and a third transfer module which connects the second transfer module and the temporary stacking module with each other or the second transfer module and the second connection module with each other, and wherein a portion of the second transfer module or the entire second transfer module is rotated with respect to the discrimination module, and a portion or the entire third transfer module is rotated with respect to the second transfer module.

14. The financial device of claim 13, wherein in case of rotating the medium depositing and withdrawing module in one direction, a portion of at least one of a path defined by the medium depositing and withdrawing module and a path defined by the first transfer module is opened.

15. The financial device of claim 14, wherein in case of rotating the temporary stacking module in a direction different from a rotational direction of the medium depositing and withdrawing module, the portion of at least one of a path defined by the temporary stacking module and a path defined by the first connection module is opened.

16. The financial device of claim 14, wherein when rotating the medium depositing and withdrawing modules in one direction and then rotating the first connection module, a portion of the path defined by the first connection module is opened.

17. The financial device of claim 13, wherein the first connection module together with the temporary stacking module is rotated in a second direction which is opposite to the first direction, and the temporary stacking module is further rotated in the second direction in a state the first connection module and the temporary stacking module are rotated together.

18. The financial device of claim 13, further comprising a first frame in which the second connection module is installed, and a second frame that is rotatably connected to the first frame, wherein at least one of the medium depositing and withdrawing module, the discrimination module, the first transfer module, the temporary stacking module, and the first connection module is rotatably connected to the second frame.

19. The financial device of claim 18, wherein the second frame is rotated in a first direction with respect to the first frame, and the temporary stacking module and the first connection module are rotated in a second direction opposite to the first direction.

20. The financial device of claim 18, wherein the second connection module comprises an upper guide and a lower guide to define a path, and the upper guide is rotated in the first direction with respect to the first frame.

* * * * *